US005108098A

United States Patent [19]

Ashihara

[11] Patent Number: 5,108,098

[45] Date of Patent: Apr. 28, 1992

[54] POLICE BATON WITH CROSSHANDLE HAVING ROTATABLY MOUNTED DEVICE

[76] Inventor: Hideyuki Ashihara, 360-1, Samban-cho 8-chome, Matsuyama-shi, Ehime-ken, Japan

[21] Appl. No.: 733,043

[22] Filed: Jul. 19, 1991

[30] Foreign Application Priority Data

Jul. 30, 1990 [JP] Japan ..... 2-201800
Oct. 24, 1990 [JP] Japan ..... 2-286716

[51] Int. Cl.[5] ..... F41B 15/02
[52] U.S. Cl. ..... 273/84 R
[58] Field of Search ..... 273/84 R, 84 A, 84 ES

[56] References Cited

U.S. PATENT DOCUMENTS 1,130,355 3/1915 Von Eshen ..... 273/84 R
1,179,611 4/1916 Cilley ..... 273/84 R
2,253,315 8/1941 Andrus ..... 273/84 ES X
4,132,409 1/1979 Taylor ..... 273/84
4,703,932 11/1987 Kubota ..... 273/84 R

FOREIGN PATENT DOCUMENTS 61-181996 11/1986 Japan .
2-50091 2/1990 Japan .
2-50092 2/1990 Japan .

*Primary Examiner*—William H. Grieb
*Attorney, Agent, or Firm*—Nikaido, Marmelstein Murray and Oram

[57] ABSTRACT

A police baton with crosshandle comprises a baton main body and a crosshandle branched in perpendicular from the baton main body at a position longitudinally displaced from the center to one end of the baton main body, wherein at least one of shooting devices for light, acoustic wave, electromagnetic wave, gas, liquid and solid is mounted to the crosshandle relatively rotatably to the baton main body around the crosshandle as a center of rotation.

The crosshandle may have a static member secured to the baton main body and a relatively rotational member. Magnets may be disposed and to the mating faces of the static member and the relatively rotational member for controlling the pointing direction of the shooting device. The shooting device can always be directed to an opponent irrespective of the manipulation to the police baton.

4 Claims, 26 Drawing Sheets 9e
26c
28
28d
26b
27
28a
26
26a
9
3
26d
27
9f
9a
Be
9
Be
8
Be
7
2
1
13
12
11
28
9e
26
18
9k
6c
6b
6a
6
5
A 9e
31
3
30
26d
32
26
33
1
2
8
5
9f
9a
9
9k
A

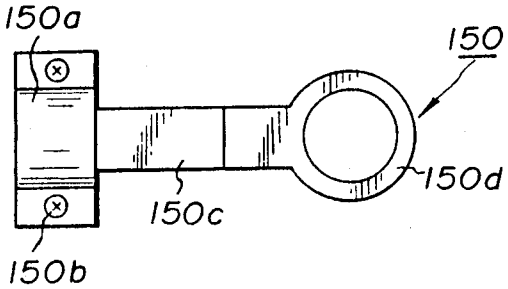
FIG. 43
FIG. 44
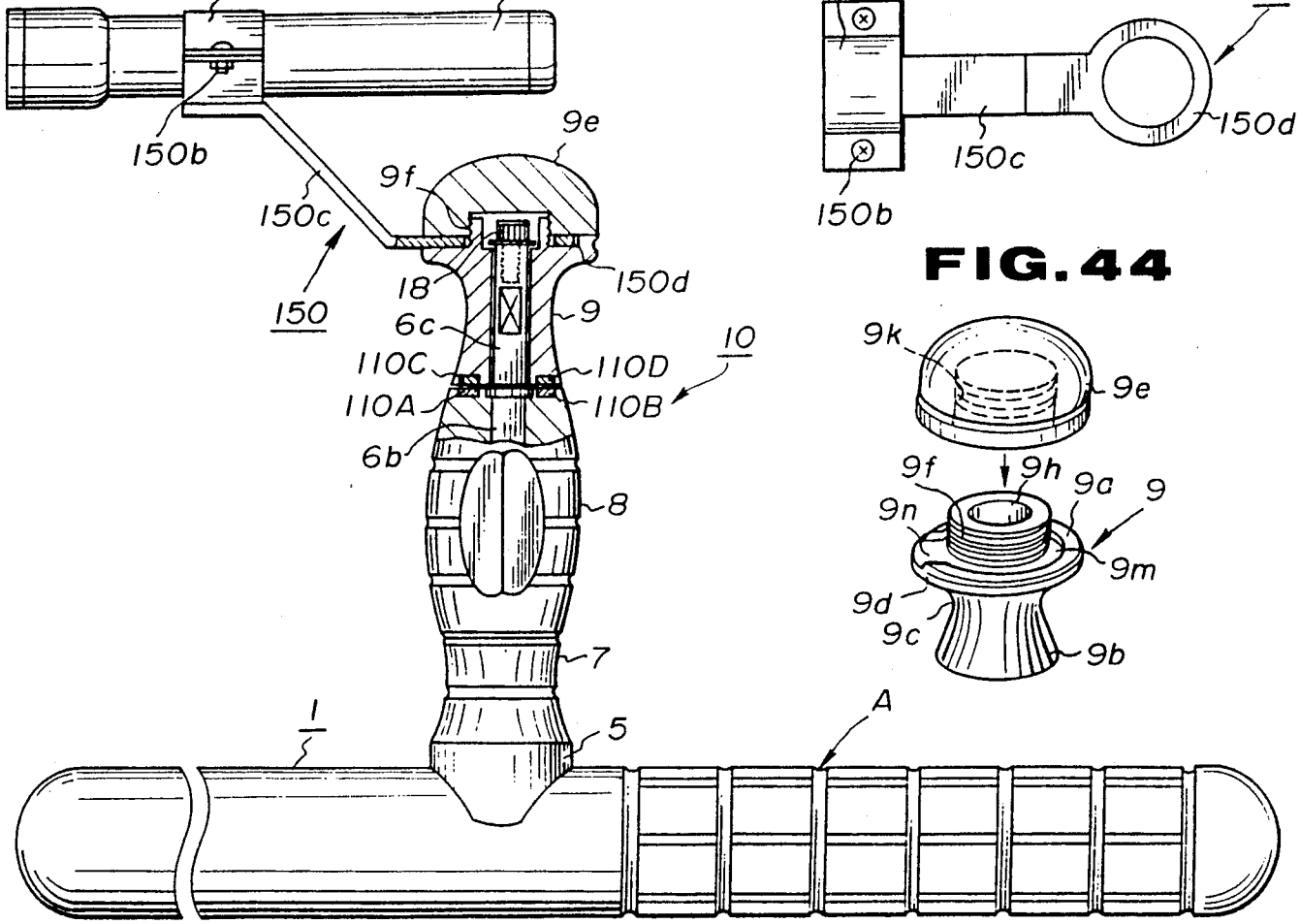
FIG. 42

153
152
154
152a
A
9e
153
9m
2
110D
110B
8
7
152a
7f
5
139
137
9f
152
9n
6c
110C
110A
6b
6a
7d
7e
154
7g
155
6
155
3L
1

POLICE BATON WITH CROSSHANDLE HAVING ROTATABLY MOUNTED DEVICE

BACKGROUND OF THE INVENTION

1. Field of the Invention

The present invention concerns a police baton with crossshandle and, more in particular, it relates to a police handle with crosshandle mounted with a device for shooting light, acoustic wave, electromagnetic wave, liquid, gas, solid or the like for illuminating an opponent or giving a shock to a resisting opponent.

2. Description of the Prior Art

A police baton carried by a police man or guardsman is generally a simply straight club and, in addition, a so-called police baton with crosshandle has also been known. Such a police baton has a crosshandle branched in perpendicular from the baton main body at a position displaced longitudinally from the center to one end of the baton main body. A user of the police baton usually grips the crosshandle by his one hand with the little finger being positioned on the side near the baton main body and manipulates the baton while controlling the gripping force. The user performs offense and defense by striking an opponent, for example, by rotating the baton main body around the axis of the crosshandle while thrusting the baton main body, suddenly stopping its rotation or projecting the baton main body along its axial direction. If the user gets accustomed to such maneuvers, the police baton with crosshandle can be used in various way such as quick motion, high speed rotation, sudden start or stop, or jabbing from out of the opponent's view which is difficult to be foreseen and, accordingly, it is considered more effective than a simply straight baton.

Further, the police baton with crosshandle can be manipulated in the same manner as an ordinary rod-like police baton by gripping a haft at one end of the baton main body.

However, it is difficult to confirm opponent's features or to distinguish whether he has a weapon or not at night, especially, in the dark, as compared with daytime, which makes the guard extremely difficult. For instance, when a patrolling police man who intends to interrogate an opponent approaches him while holding a flashlight by one hand and illuminating him and, if the police man is suddenly attacked by the opponent with a weapon such as a cutlery, his counter attack by promptly drawing out a police baton suspended from the waste by the other hand may be often too late. However, it is extremely threatening and hence not preferred to approach a yet unidentified opponent with the police baton at the ready.

Further, a highly skilled technique will be required for a police man that he fights against simultaneous offense from a plurality of opponents, by merely using a police baton, even when it is not at night, and it is usually difficult. For such an emergent offensive attack, use of a hand gun may be considered, but it is dangerous in a situation that common people are present near at hand.

In view of the above, the present inventor has previously proposed a police baton with crosshandle having at least one of a light shooting device and a device for shooting a tear gas or the like disposed to the inside of a baton main body of a police baton with crosshandle so the light or tear gas can be discharged at any time from the top end of the baton main body (Japanese Patent Laid Open Hei 2-50092).

When a police man or the like carries such a police baton with crosshandle, he is free from a trouble of carrying about a flashlight in addition to the police baton or the hand gun even for the watch at night. In addition, when the policeman intends to check up an opponent by illuminating him with a flashlight and suddenly undergoes attack by the opponent, he can instantly cope with it by shooting the gas or rotating the baton main body at high speed. Thus, the function of the police baton with crosshandle as a weapon can be extended greatly.

However, when a police baton with a crosshandle is used for thrusting an opponent, the baton main body is often rotated around the crosshandle gripped by a hand as an axis of rotation. Then, since a shooting port of light or gas disposed at the end of the baton main body is rotated together with the baton main body, it can not be pointed to a fixed direction. Accordingly, it is impossible to shoot light or the like during the rotating manipulation and there has still been a room for the improvement of disadvantage that the opponent is missed in the dark, tending to cause an error in view of a brief timing or aim.

OBJECT AND SUMMARY OF THE INVENTION

In view of the above, the present invention has been achieved taking notice on the foregoing subject in the prior art and an object thereof is to provide a police baton with crosshandle capable of always directing a shooting device to an opponent during rotating manipulation of the police baton conducted by gripping the crosshandle, as well as manipulation thereof like a sword by gripping a haft at one end of a baton main body as in a case of a rod-like police baton.

The foregoing object of the present invention can be attained by a police baton with a crosshandle comprising a baton main body and a crosshandle branched in perpendicular from the baton main body at a position longitudinally displaced from the center to one end of the baton main body, wherein at least one of shooting devices for light, acoustic wave, electromagnetic wave, gas, liquid and solid is mounted to the crosshandle relatively rotatably to the baton main body around the crosshandle as a center of rotation.

In a modified embodiment of the present invention, the crosshandle may comprise at least a static member secured to a baton main body and a relatively rotational upper member rotatably attached to a free end of the static member, in which the shooting device is mounted to the relatively rotational upper member directly or by means of a mounting member.

In another modified embodiment of the present invention, the crosshandle may comprise at least a static member secured to the baton main body, a relatively rotational upper member rotatably attached to a free end of the static member and further comprising a hand guard generally in a C-shaped configuration having an upper end mounted to the relatively rotational upper member and made relatively rotatable around the crosshandle as a center of rotation, in which the shooting device is mounted to the hand guard.

Further, the present invention also provides a police baton with crosshandle comprising a baton main body having a gripping haft disposed at one end thereof and a crosshandle branched in perpendicular from the main body at a position displaced toward the gripping haft, in which the crosshandle comprises at least a static member secured integrally to the baton main body and a relatively rotational upper member attached rotatably around its axis to the free end of the static member, wherein at least one of shooting devices for light, acoustic wave, electromagnetic wave, gas, liquid and solid is mounted to the crosshandle relatively rotatably to the baton main body around the crosshandle as a center of rotation, and magnets are attached to the end face at the free end of the static member and at the opposing end face of the relatively rotational upper member of the crosshandle, respectively for controllong the pointing direction of the shooting device.

When the police baton with a crosshandle having the constitution as described above is manipulated by gripping a crosshandle with one hand, a rotational portion in the crosshandle relative to the baton main body is always gripped tightly and a portion fixed to the baton main body is gripped loosely. In this state, the baton main body is rotated at a high speed by the operation of the hand that grips the crosshandle, the police baton under rotation is stopped suddenly by tightly gripping the portion fixed to the baton main body or the baton is thrusted straight forward. Since the shooting device is mounted to a portion rotatable relative to the baton main body, the pointing direction of the device can be controlled optionally by the hand gripping the crosshandle irrespective of the rotation of the baton main body, and the baton main body can be rotated optionally while overcoming the magnetic force of the magnets disposed in the crosshandle. Accordingly, the shooting device attached to the crosshandle is always kept immovable to the gripping hand and can be pointed to the opponent even how the baton main body is rotated freely.

On the other hand, in a case of manipulating the police baton like that a sword such as striking, thrusting and sweeping by gripping not the crosshandle but the haft at one end of the baton main body, the crosshandle is released from gripping and magnets, which are assembled in opposition to each other into relatively rotatable portion and the portion fixed to the baton main body of the crosshandle, attract to each other at their poles of different polarities, and restrict the relatively rotatable portion. This also regulates the shooting device from taking random direction and the pointing direction is determined in accordance with the direction of disposing the magnets.

In this way, it is possible to direct the shooting port of the shooting device to an opponent not only in a case of gripping the crosshandle but also in a case of gripping one end of the baton main body, so that it is possible to operate the police baton while always illuminating to confirm the opponent irrespective of the way of gripping and to shoot a tear gas or the like at the most effective timing, thereby giving shock to the opponent and promptly discouraging him.

BRIEF DESCRIPTION OF THE DRAWINGS

These and other objects, features as well as advantageous objects of the present invention will become apparent by reading the following descriptions for the preferred embodiments according to the present invention with reference to the accompanying drawings, wherein

FIG. 20(*b*) is a perspective view of a hand guard thereof;

FIG. 42 is a side elevational view partially in cross section of a 17th embodiment according to the present invention;

FIG. 43 is a plan view for a mounting member shown in FIG. 42;

FIG. 44 is an exploded perspective view of the relatively rotational upper member shown in FIG. 42;

DETAILED DESCRIPTION OF THE PREFERRED EMBODIMENTS

The resent invention will now be described by way of its preferred embodiments with reference to the accompanying drawings.

Example 1

Figure 1:
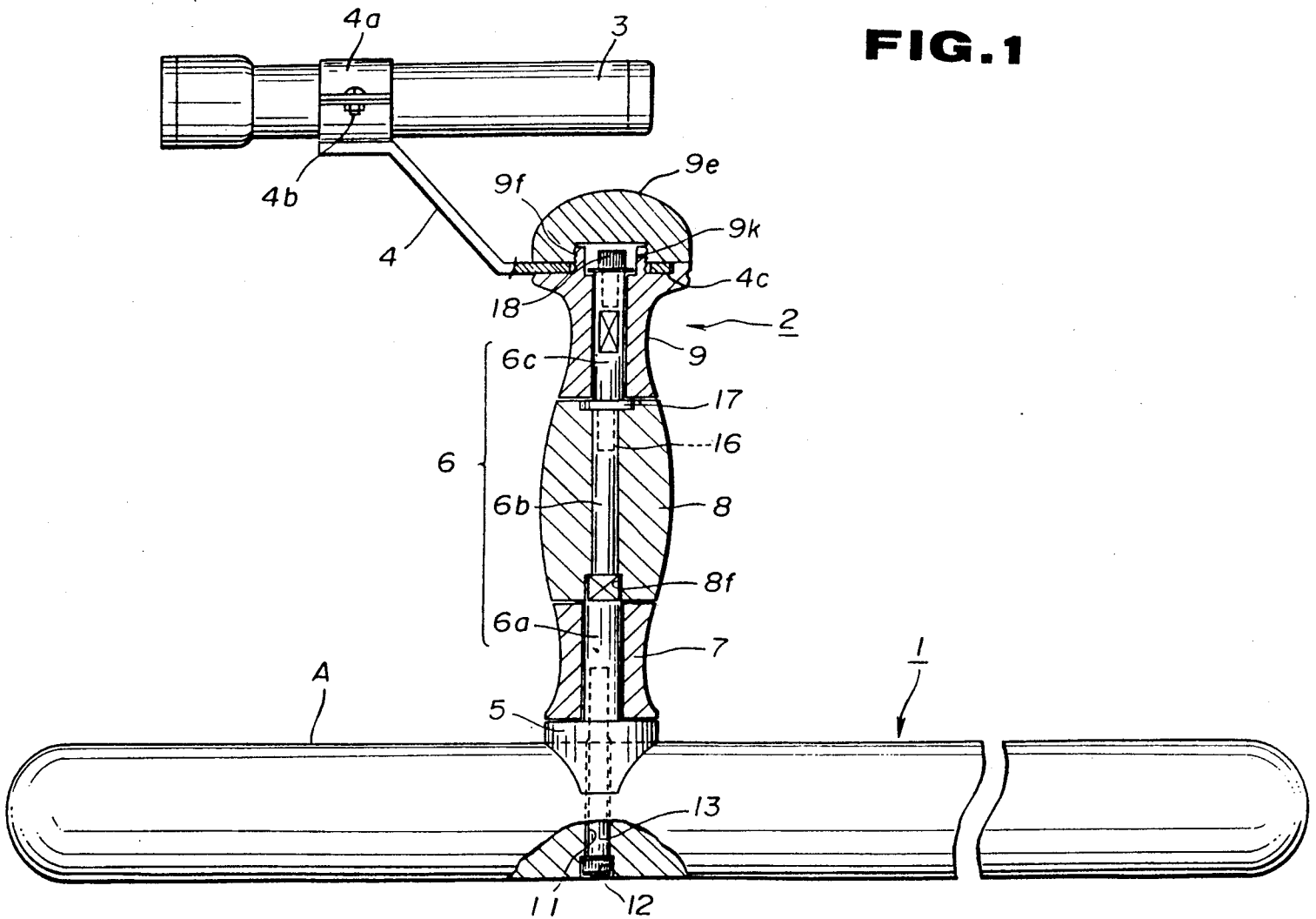
FIG. 1 is a side elevational view partially in vertical cross section of a first embodiment according to the present invention.
Figure 8:
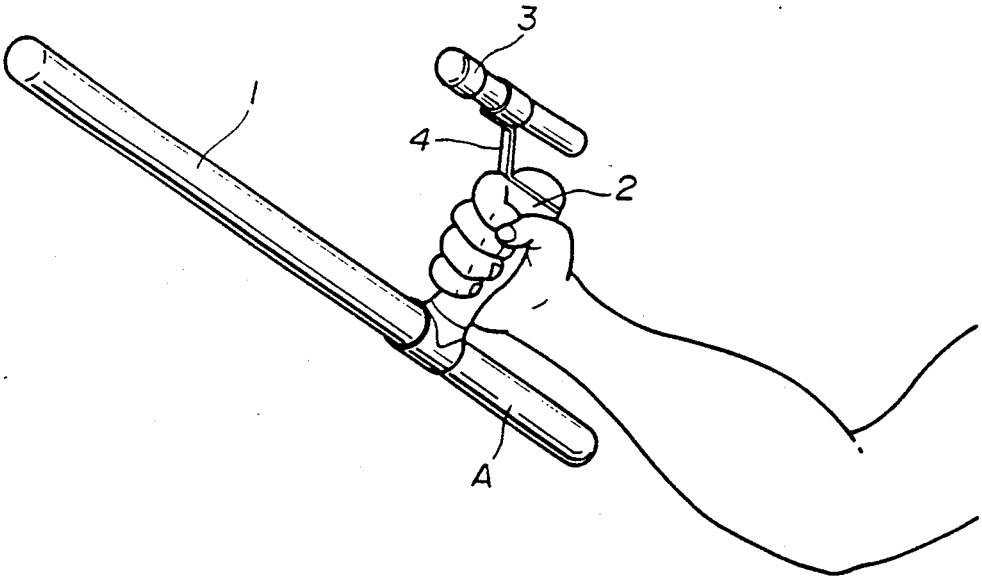

FIG. 1 through 1 through FIG. 8 illustrate a first embodiment according to the present invention. In the drawings, reference numeral 1 denotes a baton main body. The baton main body 1 has a crosshandle 2 of such a length as can be gripped by one hand and branched in perpendicular from the baton main body 1 at a position between the longitudinal center and one end of the baton main body 1, that is, at a position near a gripping haft A disposed at one end of the baton main body 1. A small flashlight 3 as a light shooting device is mounted to the upper end of the crosshandle 2 by way of a mounting member 4 so as to be rotatable relative to the baton main body 1 around the crosshandle 2 as the center of rotation.

The crosshandle 2 in this embodiment is made rotatable at an upper portion and a lower portion while fixed at a middle portion. That is, it has, at the axial center of the handle, a shaft 6 extended vertically relative to the baton main body 1 from a mounting base 5 for securing to the baton main body 1. A relatively rotational lower member 7 is rotatably fit loosely around the base end 6*a* of the shaft 6. A static member 8 is fit around and fixed to an intermediate portion 6*b* of the shaft 6. Further, a relatively rotational upper member 9 is loosely fit rotatably around the top end 6*c* of the shaft 6.

Figure 2:
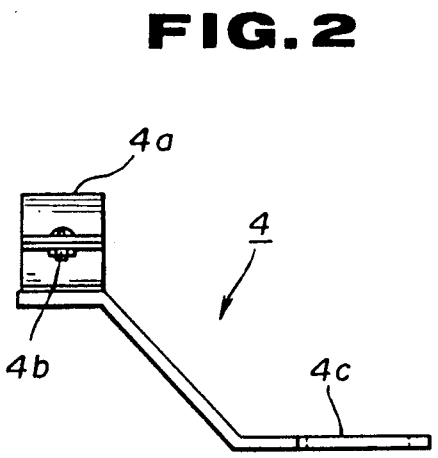
FIG. 2 is a side elevational view of a shooting device mounting member.
Figure 3:
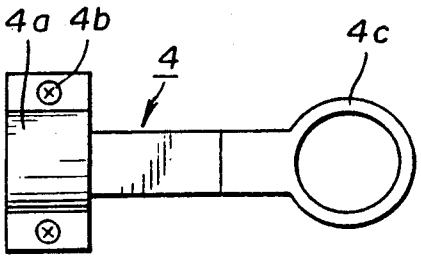
FIG. 3 is a plan view of the member shown in FIG. 2.

As shown in FIG. 2 and FIG. 3, the flashlight 3 is held to a bisected tubular holder 4*a* of the mounting member 4 by means of screws 4*b*, and mounted to the crosshandle 2 by fitting to fix a ring-like base 4*c* of the mounting member 4 to the relatively rotational upper member 9.

Figure 4:
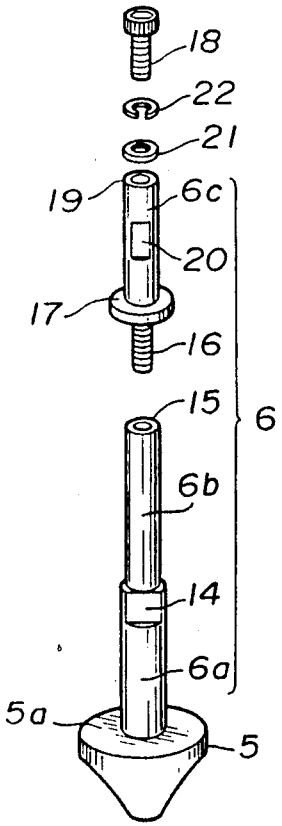
FIG. 4 is an exploded perspective view of a shaft shown in FIG. 1.

Explanations will be made more in details for the crosshandle 2 with reference to the exploded perspective views of FIG. 4 and FIG. 5. The mounting base 5 for the shaft 6 has a saddle-shaped lower end formed such that it is in an intimate contact with the outer circumference of the baton main body 1. The base end 6*a* of the shaft secured integrally to the base 5 has a threaded bore axially formed in the lower portion thereof. On the other hand, a through hole 11 in perpendicular to the axis and a spot facing 12 are disposed at a predetermined position to the side of the baton main body 1 (refer to FIG. 1). The mounting base 5 and the base end 6*a* of the shaft 6 are fixed to the baton main body 1 by mating the mounting base 5 of the shaft 6 to the outer circumferential surface of the baton main body 1, in which the through hole 11 is opened and engaging and clamping a bolt 13 inserted from the side of the spot facing 12 into the threaded bore of the base end 6*a* for the shaft. The upper surface of the mounting base 5 thus fixed to the baton main body 1 is formed as a flat surface 5*a*. The shaft 6 stand vertically at the center of the flat surface 5*a*. It has the greatest shaft diameter at the base end 6*a* and is chamfered at the upper circumferential side of the base end 6*a* to form a flat surface 14 for inhibiting the rotation of the static member 8.

An intermediate portion 6*b* with a somewhat smaller shaft diameter and having a female thread 15 in the upper end is extended integrally from above the base end 6*a*. A top end 6*c* of the shaft 6 has, at the lower portion, a female thread 16 that engages the female thread 15 in the intermediate portion 6*b* and a flange 17 extended in a disk-like shape. In the upper portion, it has a female thread 19 for engaging a bolt 18 and a chamfered flat surface 20 formed to the outer circumference to be applied with a wrench (not shown). 21 denotes a flat washer and 22 denote a spring washer.

Figure 5:
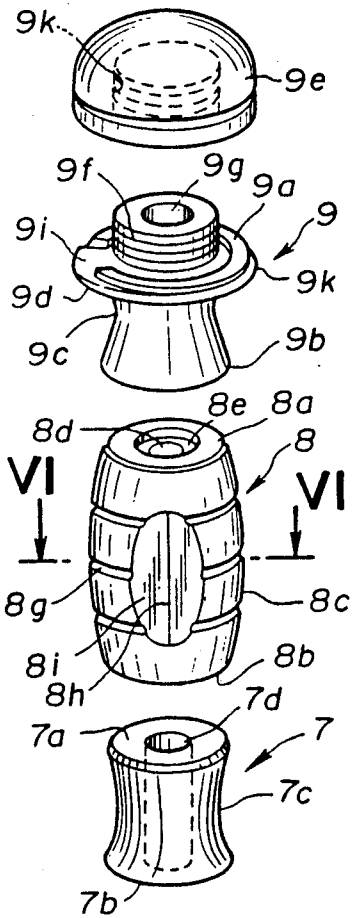
FIG. 5 is an exploded perspective view of a grip of a crosshandle shown in FIG. 1.

FIG. 5 is an exploded perspective view of a grip, in which a relatively rotational lower member 7 comprisies an upper surface 7*a* and a lower surface 7*b* flattened respectively, an outer circumferential surface 7*c* curved inward into a concave face and a through hole 7*d* formed in the axial center to which the base end 6*a* of the shaft 6 is loosely fit.

Figure 6:
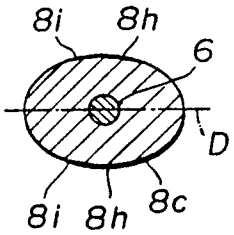
FIG. 6 is a cross sectional view taken along lines VI—VI in FIG. 5.

The static member 8 comprises an upper surface 8*a* and a lower surface 8*b* flattened respectively, an outer circumferential surface 8c bulged outward into a convex face and a through hole 8d formed at the axial center through which the intermediate portion 6b of the shaft 6 is inserted. A recess 8e is formed to the upper portion of the through hole 8d for receiving the flange 17 of the intermediate portion 6b. A long hole 8f is formed to the lower portion of the through hole 8d for engaging the flat surface 14 at the upper end of the base end 6a for the shaft 6 (refer to FIG. 1). Further, a plurality of recessed grooves 8g are formed along the outer circumferential surface 8c for preventing a gripping hand from slipping. As shown in FIG. 6, a middle portion of the outer circumferential surface 8c has a substantially elliptic transversal cross section. It is not always restricted to the illustrated elliptic shape but other non-circular shapes may also be used. Further, the portion is chamfered so that an intersection 8h between the shorter diameter of the elliptic shape and the outer circumferential surface 8c is slightly ridged outwardly to form an angled gripping face 8i. When the static member 8 is fixed to the shaft 6, the flat surface 14 of the base 6a of the shaft 6 fits the flat surface of the long hole 8f opened to the lower surface 8b of the static member 8. This aligns a long diameter D of the non-circular cross section of the static member 8 with the axial direction of the baton main body 1 to give a reliable directionality to the police baton with crosshandle.

The relatively rotational upper member 9 is flattened at an upper surface 9a and a lower surface 9b. The diameter of an outer circumferential surface 9c is gradually reduced upwardly from the lower end and suddenly enlarged at the upper portion to form an anti-slip off retaining portion 9d. The diameter of the retaining portion 9d is large enough to ensure a sufficient retention when the outer circumferential surface 8c is gripped with a thumb and a forefinger being wound therearound.

The upper surface 9a just above the retaining portion 9d has a male thread 9f protruded therefrom for engaging a female thread 9k of an upper cap 9e. A through hole 9g is formed in the axial center for loosely inserting the top end 6b of the shaft 6. Further, the female thread 9f has a recessed groove 9h and an opening 9i therefor formed at the base portion thereof for receiving the ring-like base 4c of the mounting member 4 of the shooting device 3.

The crosshandle 2 is assembled by the following sequence:

(1) The relatively rotatable lower member 7 is put around the base end 6a of the shaft 6.

(2) The static member 8 is put around the intermediate portion 6b of the shaft 6 to engage the flat surface 14 in the upper portion of the base end 6a with the long hole 8f.

(3) Then, the static member 8 is integrally secured to the base end 6a of the shaft 6 and hindered from its self-rotation.

(4) Then, the top end 6c of the shaft 6 is screw-coupled to the intermediate portion 6b.

(5) The relatively rotatable upper member 9 is put over the top end 6c.

(6) The bolt 18 is screwed by way of the flat washer 21 and the spring washer 22 into the female thread 19 in the top end 6c of the shaft 6 to support the relatively rotatable upper member 9 self-rotatably.

(7) The ring-like base 4c of the mounting member 4 is fitted into the recessed groove 9h and the opening 9i formed at the upper surface of the relatively rotatable upper member 9.

(8) Finally, the mounting member 4 is firmly fixed to the relatively rotatable upper member 9 by screw-coupling to clamp the female thread 9k of the upper cap 9e with the male thread 9f of the relatively rotatable upper member 9.

The operation of the police baton with crosshandle will now be explained.

A user of the police baton with crosshandle can use it like that a sword by gripping the gripping haft A at the end of the baton main body 1. However, usage of rotating the baton main body 1 by gripping the crosshandle 2 is more effective.

In this case, the crosshandle 2 is held by positioning a thumb and a forefinger of one hand around the outer circumferential surface 9c of the relatively rotatable upper member 9 of the crosshandle 2. The little finger is positioned around the relatively rotatable lower member 7 of the crosshandle 2. In the rotating manipulation, gripping force other than that of the thumb, the forefinger and the little finger is loosened to release the static member 8 of the crosshandle 2 in order to give a rotating force by the movement of an arm and a wrist. The relatively rotatable upper member 9 and the relatively rotatable lower member 7 are gripped as they are and secured within the hand, while the static member 8, the baton main body 1 and the shaft 6 are rotated integrally around the shaft 6 as an axis of rotation. For stopping the rotation, the static member 8 is firmly gripped to apply a braking effect on the rotation of the baton main body 1.

Also during the rotating operation, the thumb and the forefinger firmly holding the relatively rotatable upper member 9 of the crosshandle 2 are retained at the retaining portion 9d. Accordingly, even when violent rotating manipulations are repeated, the police baton is neither shifted downward nor slipped off from the hand.

The relatively rotatable upper member 9 makes the flashlight 3 mounted by way of the mounting member 4 always independent from the rotational movement of the baton main body 1 and the static member 8 of the crosshandle 2.

That is, the flashlight 3 is always pointed substantially in the same direction as that of the knuckle of the gripping hand even how the baton main body 1 is manipulated rotationally by gripping the crosshandle 2.

Figure 7:
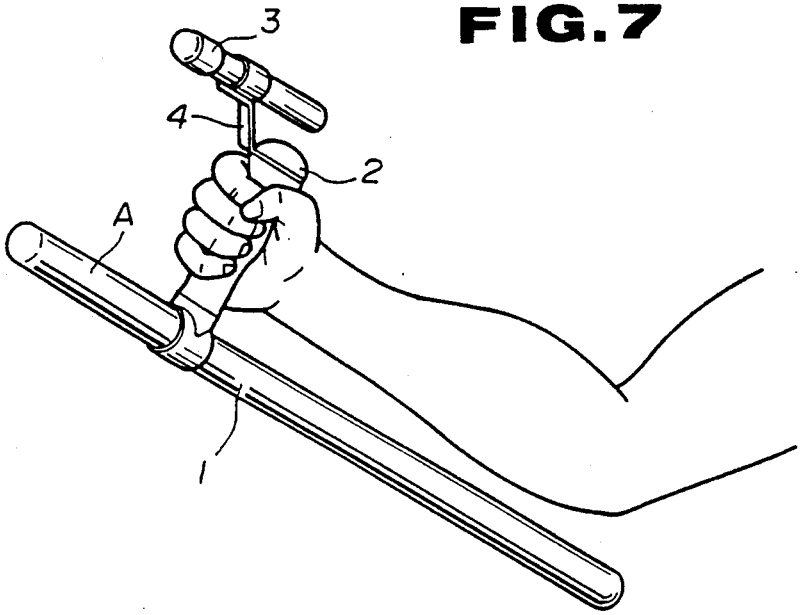
FIGS. 7 and 8 are, respectively, views for illustrating a mode for using the police baton with a crosshandle shown in FIG. 1.

Explanation will now be made to an example of a mode of using the police baton of this embodiment having such features. For instance, when a police man conducts questioning in the dark, he previously draws the police baton with crosshandle which is usually carried about by being suspened from his waist. As shown in FIG. 7, when the crosshandle 2 is gripped and the flashlight 3 is lit while pointing the top end of the gripping haft A of the baton main body 1 to an opponent, the opponent can be illuminated straight forward. In this case, since the opposite side of the gripping haft A of the baton main body 1 comes under the arm, there is no disadvantage of giving unnecessary threatening impression to the opponent. In addition, even if the opponent suddenly attacks by a weapon or the like, the police man can instantly sweeping off the opponent's weapon by swiftly swinging his arm gripping the crosshandle 2 forward and rotating the baton main body 1 as shown in FIG. 8. Since the flashlight 3 is kept to be pointed to the opponent also during this operation, there is no worry of missing the opponent due to this counter attack motion as described above. At the same time, since the police man can take a step forward and, while breaking the opponent's balance by his left hand, can manipulate the crosshandle 2 freely by the right hand, it is possible to hit and down the opponent by rotating the baton main body 1 or thrust down the opponent at the end of the baton by thrusting the baton main body 1 straight forward, while surely catching the opponent under the light of the flashlight 3. In this way, it is a remarkable merit of the police baton with crosshandle according to this invention that it gives no unnecessary threatening or warning impression to the opponent and can instantly cope with sudden change of the situation.

Further, in the above-mentioned operation, the longer diameter of the non-circular cross section of the static member 8 of the crosshandle 2 always aligns with the axial direction of the baton main body 1. Accordingly, the pointing direction of the baton main body 1 can be controlled extremely easily by the feeling of the hand that grips the static member 8 under rotation toghether with the baton main body 1 even in such a situation that visible recognition is difficult, for example, at night.

In addition, it is easy to suddenly stop the rotation of the static member 8 and thus the rotation of the baton main body 1 by tightly gripping the gripping surface 8*l* chamfered into an angled shape disposed to the outer circumferential surface 8*c* of the static member 8, thereby applying a braking effect and it can be manipulated easily even by a beginner.

Description will now be made to other examples. In each of the following examples, identical or corresponding portions carry the same reference numerals, for which duplicate explanation will be omitted.

EXAMPLE 2

Figures 9, 10:
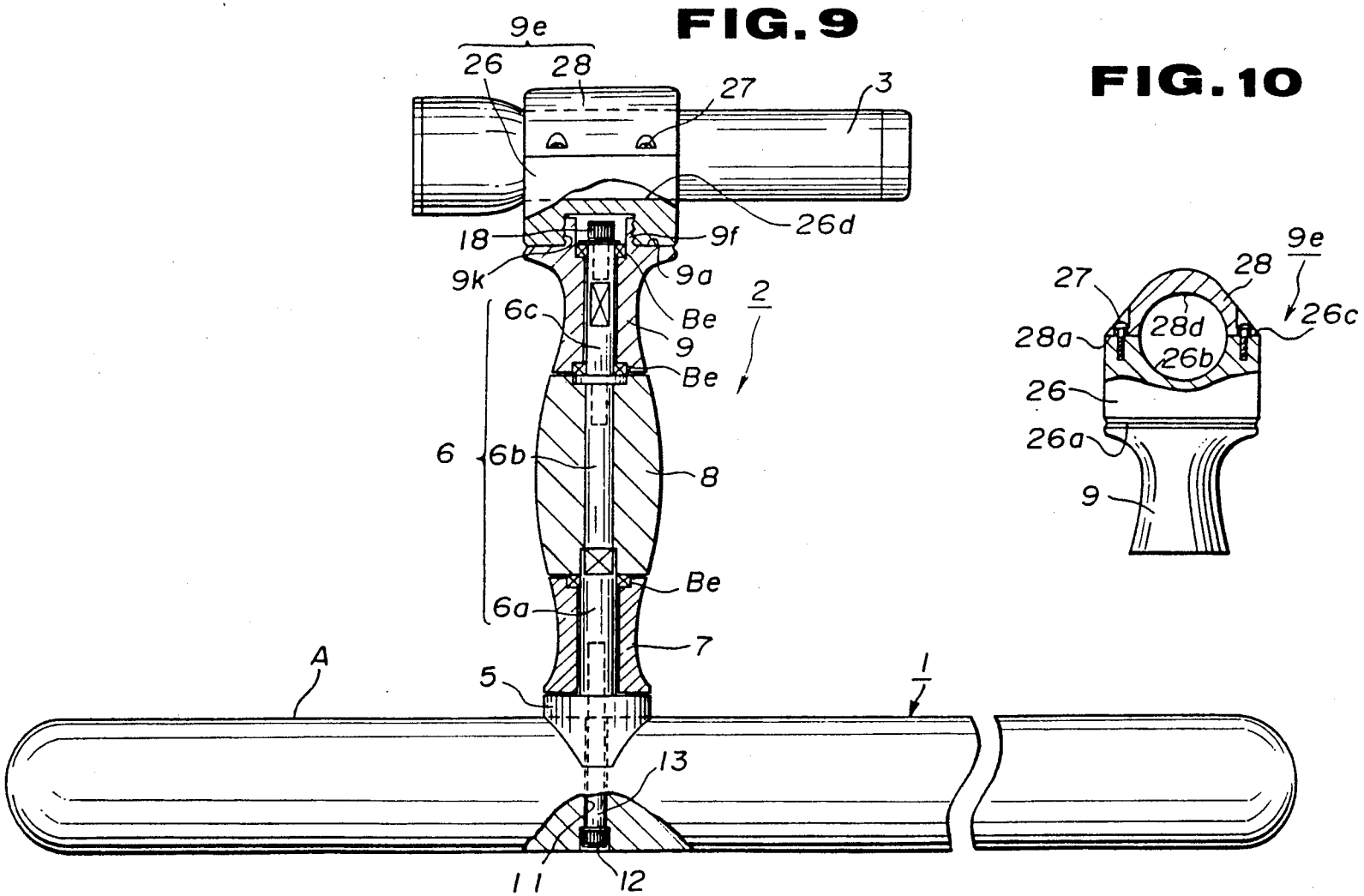
FIG. 9 is a side elevational view partially in vertical cross section of a second embodiment according to the present invention.
FIG. 10 is front elevational view partially in vertical cross section of a main portion shown in FIG. 9.

FIG. 9 and FIg. 10 show a second embodiment.

In this embodiment, the mounting structure for a flashlight 3 is different from that in the first embodiment, in which the flashlight 3 is mounted directly to a cap 9*e* for a relatively rotatable upper member 9. That is, the cap 9*e* comprises a square cylindrical cap main body 26 and a saddle-shaped mpinting member 28 detachably screw-coupled over the cap member 26 by means of four settling screws 27. The cap main body 26 has a circular lower surface 26*a* corresponding to an upper surface 9*a* of the relatively rotatable upper member 9 and a female thread 9*k* engaging the male thread 9*f* of the relatively rotatable upper member 9 formed at the central portion thereof. Further, an upper surface 26*c* has a semi-circular recessed groove 26*d* for receiving the flashlight 3. On the other hand, a lower surface 28*a* of the mounting member 28 has a semi-circular recessed groove 28*d* opposed to the recessed groove 26*d* of the cap main body 26.

The flashlight 3 is fit into the recessed groove 26*d* in the cap main body 26, then the mounting member 28 is placed and the flashlight 3 is fit to the recessed groove 28*d*. Subsequently, the flashlight 3 is firmly secured by clamping the setting screws 27. Since the flashlight 3 in this embodiment can be mounted directly to the cap 9*e* of the relatively rotatable upper member 9 not by way of the mounting member 4, it has an advantage of providing a more stable structure.

Further, in this embodiment, rolling bearings or sliding bearings be made of a resin of low friction coefficient such as a fluoro resin or a polyamide resin are incorporated into the relatively rotatational lower member 7 and the relatively rotational upper member 8 of the crosshandle 2. This can provide a functional merit that the relative rotation between the relatively rotational lower member 7 and the relatively rotational upper member 9 is made more smooth and they can be moved easily at a high speed. It will be apparent that such bearings can also be used in other embodiments although not illustrated in particular.

EXAMPLE 3

Figures 11, 12, 13:
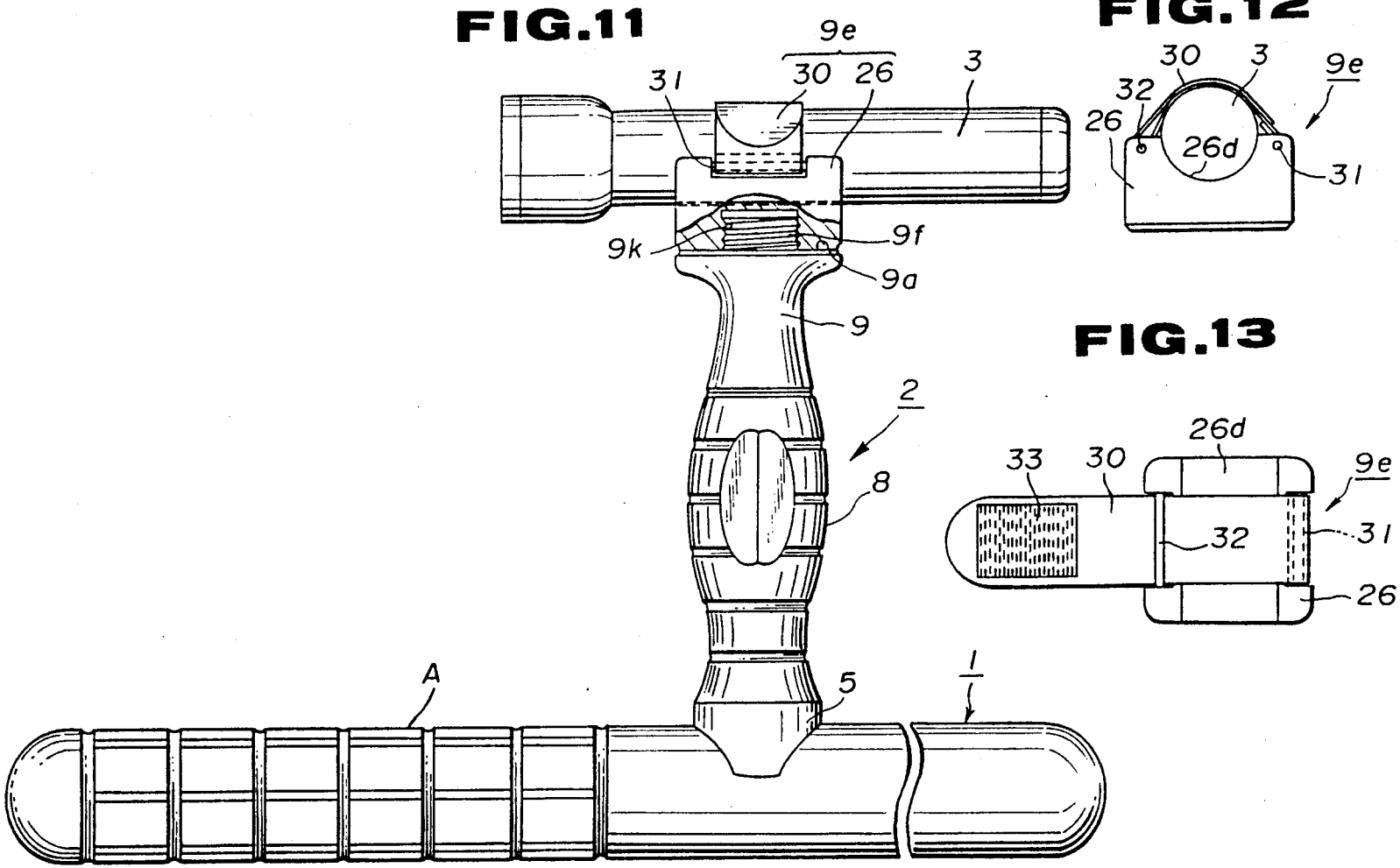
FIG. 11 is a side elevational view partially in vertical cross section of a third embodiment according to the present invention.
FIG. 12 is a front elevational view of a cap shown in FIG. 11.
FIG. 13 is a plan view of a sap shown in FIG. 12 with a portion being turned open.

FIG. 11 through FIG. 13 show a third embodiment.

In this embodiment, a rubber band 30 is used instead of the saddle-shaped mounting member 28 which is a constituent portion of the cap 9*e* in the second embodiment described above. One end of rubber band 30 is wound around and secured to one shaft 31 fixed to the upper side of the cap main body 26. The other end of the rubber belt 30 is made as a free end. The free end is passed around the other shaft 32 secured to the opposite upper side of the cap main body 26, and then turned back and fastened with a magic tape 33. In this way, the flashlight 3 fit into the recessed groove 26*d* of the cap main body 26 is retained and fixed by the rubber belt 30. This can provide a merit that the flash lamp 3 can be attached and detached in one touch operation.

Instead of fastening with the magic tape 33, a hook may be secured to the free end of the rubber belt 30 and the hook may be engaged to retain on the side of the other shaft 31.

In addition, the crosshandle 2 in this embodiment has no relatively rotatational lower member 7 as in the crosshandle 2 in each of the first and the second embodiments described above and it is constituted as an upper rotational type comprising a static member 8 and a relatively rotational upper member 9.

That is, the static member 8 constituting the crosshandle 2 is formed in such an outer shape that the lower end thereof is extended by a portion corresponding to the relatively rotational lower member 7 in the first of the second embodiment and fixed to the shaft 6 not rotatably. However, an upper and lower rotational type comprising the relatively rotational lower member 7 may also be used for the crosshandle 2 in this embodiment. Referring to the type of the crosshandle 2, both of the upper and lower rotational type having the relatively rotational lower member 7 and the relatively rotational upper member 9 and the upper rotational type comprising only the relatively rotational upper member 9 but lacking in the relatively rotational lower member 7 can be used.

EXAMPLE 4

Figures 14, 15:
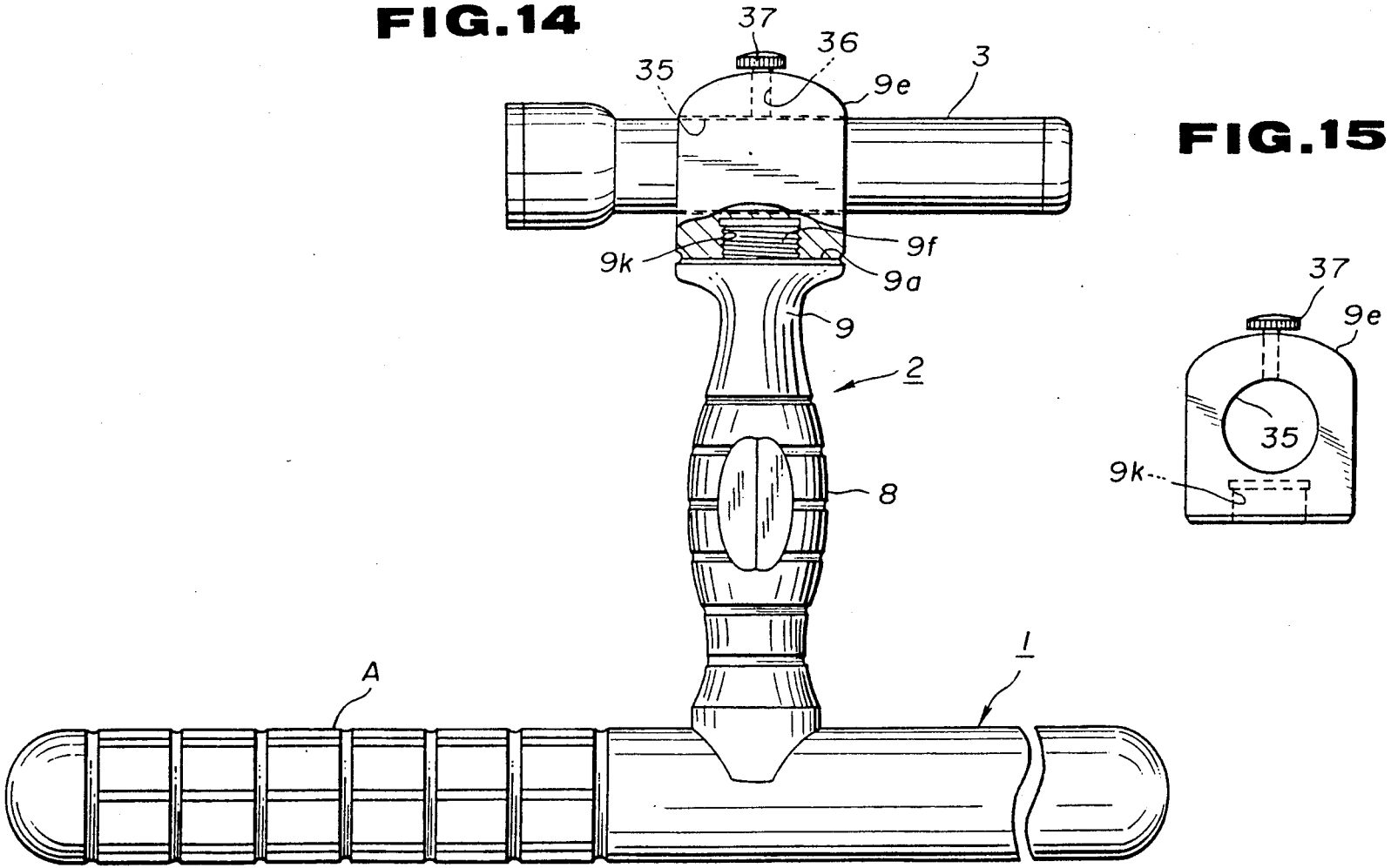
FIG. 14 is a side elevational view partially in vertical cross section of a fourth embodiment according to the present invention.
FIG. 15 is a front elevational view of a cap shown in FIG. 14.

FIG. 14 and FIG. 15 show a fourth embodiment.

In this embodiment, a cap 9*e* for a relatively rotational upper member 9 has a cylindrical configuration with a spherical top. A through hole 35 is disposed diametrically passing the cylinder for inserting a flashlight 3 therethrough. Further, it has a female threaded bore 36 extended from the top of the cap 9*e* to the through hole 35. The flashlight 3 inserted through the through hole 35 is fixed to the cap 9*e* by clamping a setting screw 37 that is screw-coupled with the male thread bore 36.

EXAMPLE 5

Figures 16, 17:
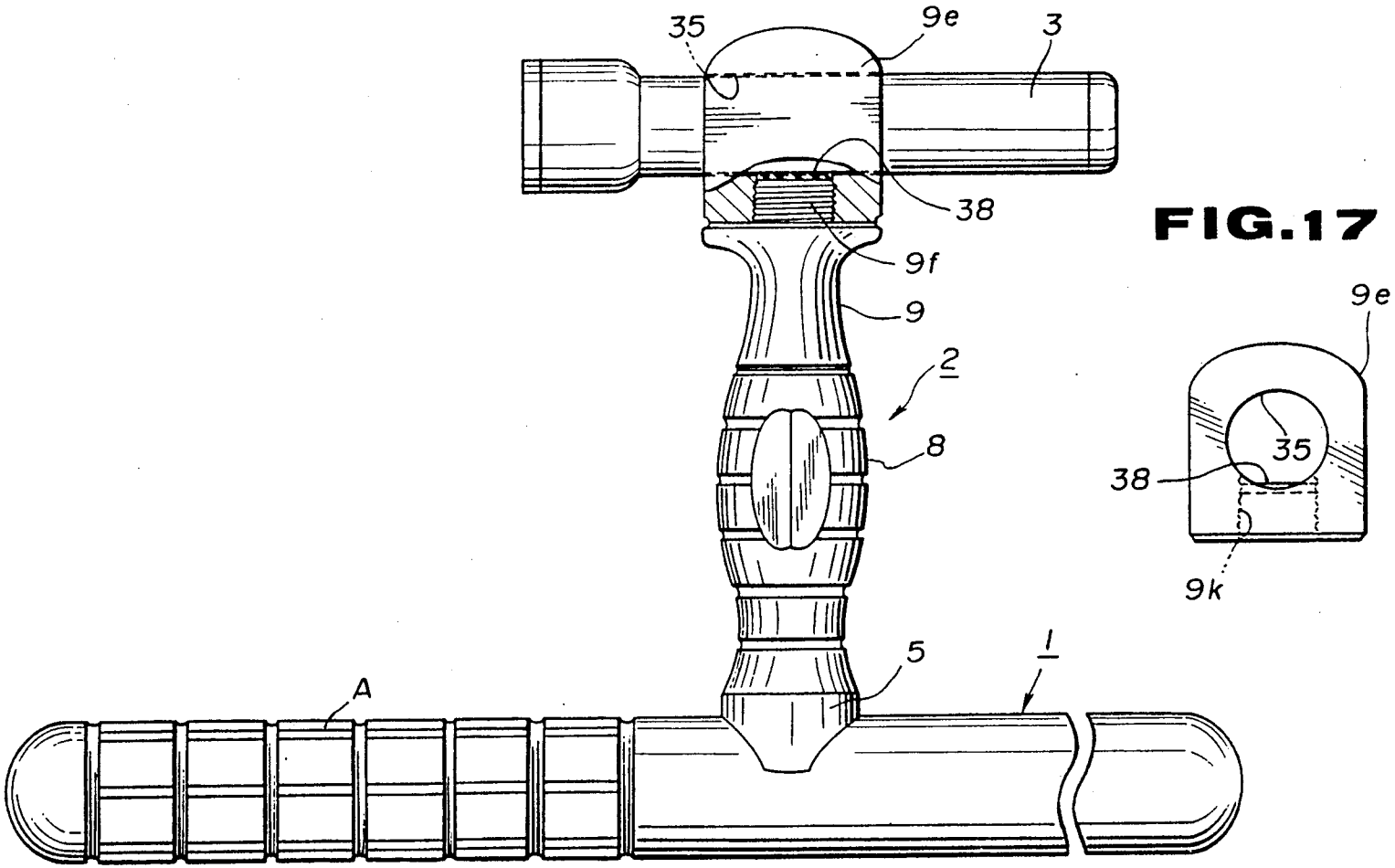
FIG. 16 is a side elevational view partially in vertical cross section of a fifth embodiment according to the present invention.
FIG. 17 is a front elevational view of a cap shown in FIG. 16.

FIG. 16 and FIG. 17 show a fifth embodiment.

In this embodiment, the male thread bore 9k in the cap 9e of the relatively rotatable upper member 9 of the fourth embodiment is formed so as to be in communication with the through hole 35 for a flashlight 3. A cushioning rubber member 38 is inserted in the female thread bore 9k. Upon mounting the flashlight 3, the flashlight 3 is inserted through the through hole 35 in the cap 9e and then the cap 9e is screwed and tightened to the male thread 9f of the relatively rotational upper member 9. Then, the cushioning rubber member 38 is urged between the circumferential surface of the flashlight 3 and the end face of the male thread 9f of the relatively rotational upper member 9 to secure the flashlight 3 to the cap 9e. Thus, the setting screw 37 for securing the flashlight 3 is no more necessary.

In each of the first through fifth embodiments, the flashlight 3 as a light shooting device is mounted to the cap 9e directly or indirectly by way of the mounting member 4, but a shooting device for shooting other medium may also be mounted. For instance, there can be mentioned as practical devices, for example, a flashing device for momentarily dazzling opponent's eyes with intense light, an electromagnetic wave generating device for momentarily paralyzing the moving function of an opponent by electromagnetic wave, an acoustic wave shooting device such as for generating detonating or blowing sound that threatens an opponent or supersonic waves, a device for shooting a suppressing gas such as a tear gas, a liquid shooting device for marking a flagrant delict such as with paint or dye, or a solid shooting device for discharging metal particles or resin beads. By mounting them alone or in a combination, it is possible to halter, take a surprise or momentarily astonish an opponent, making it possible to suppress the opponent more easily.

It will be apparent that the mounting structure shown in each of the embodiments described above can be used in common for mounting various kinds of such shooting devices.

EXAMPLE 6

Figures 18, 19:
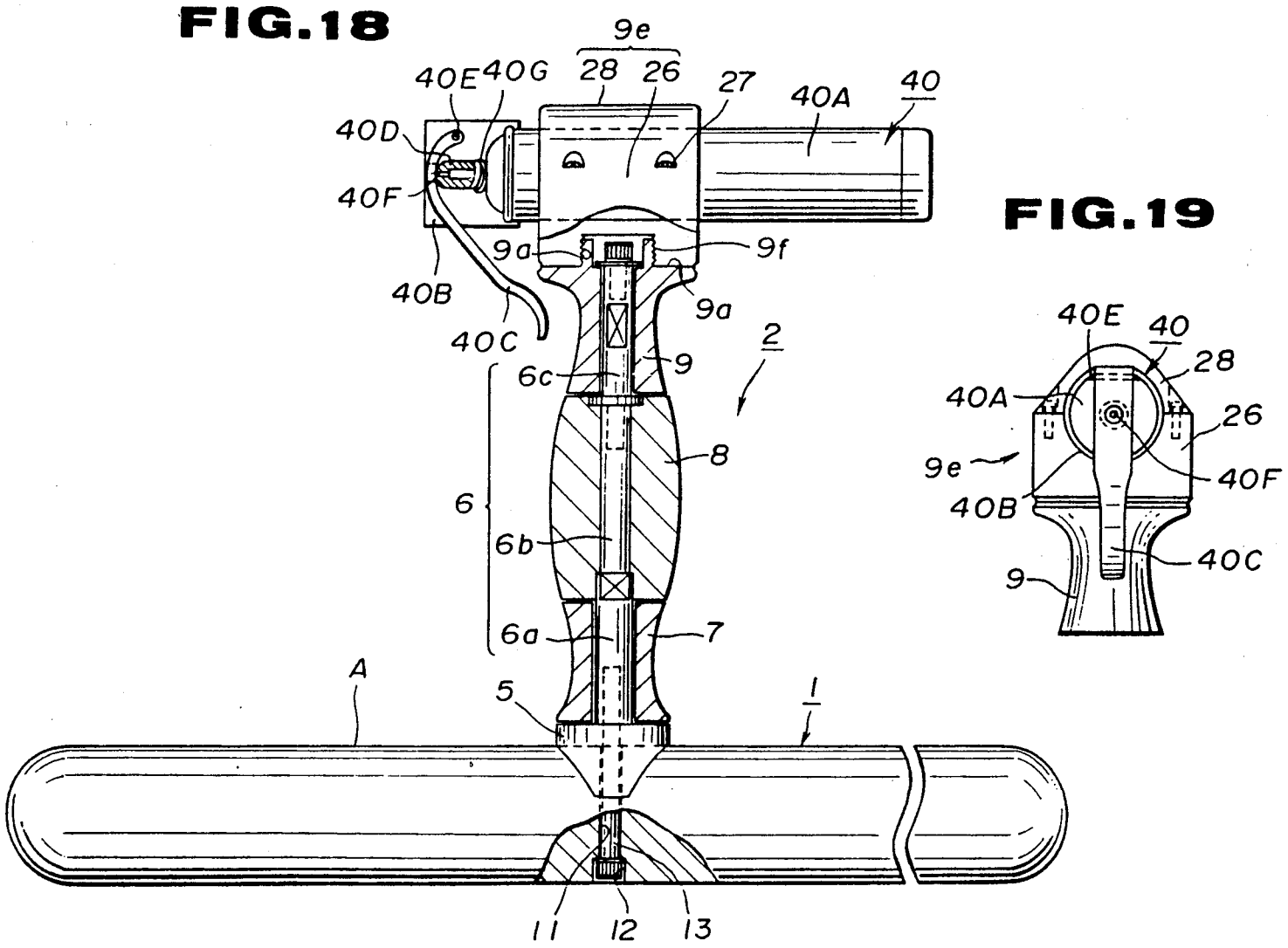
FIG. 18 is a side elevational view partially in vertical cross section of a sixth embodiment according to the present invention.
FIG. 19 is a front elevational view of a main portion shown in FIG. 18.

FIG. 18 and FIG. 19 show a sixth embodiment as one of such modes.

In this embodiment, the flashlight 3 in the second embodiment (refer to FIGS. 9 and 10) is replaced with a tear gas shooting device 40. The tear gas shooting device 40 comprises a gas cylinder 40A charged with a tear gas under pressure and a valve 40D disposed by way of an adaptor 40B to the head of the cylinder so as to be opened/closed by a lever 40C.

A user for the police baton draws the lever 40C with a forefinger of a hand gripping a crosshandle 2. Then, the lever 40C revolves around a support rod 40 E as a fulcrum to open the valve 40D and a tear gas is sprayed from a shooting port 40F. When the finger positioned to the lever 40C is released, the lever 40 is pushed back by the resiliency of a return spring 40G to close the valve 40D thereby interrupt the spray of the tear gas.

The baton user can shoot the tear gas at an optional timing while freely manipulating the police baton with crosshandle by one hand. Since the pointing direction of the shooting port 40F is independent of the rotation of a baton main body 1 but aligns with the direction of the hand gripping the crosshandle 2, it is possible to always direct the shooting port 40F to an opponent, thereby providing a merit capable of easily repressing the opponent by the combined use of the tear gas and the striking by the police baton.

EXAMPLE 7

Figure 20B:
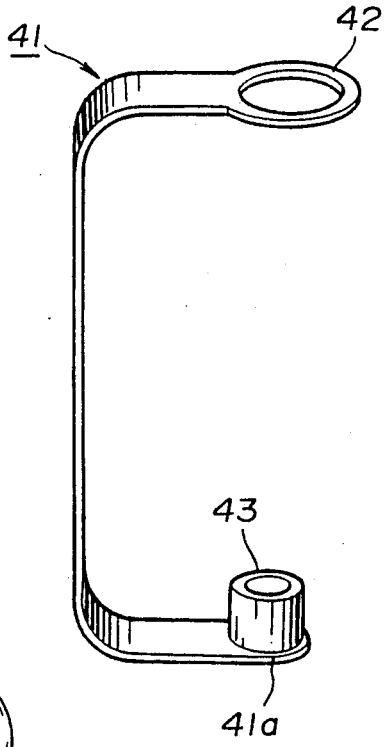
FIG. 20(*a*) is a side elevational view partially in vertical cross section of a seventh embodiment according to the present invention.
Figure 20A:
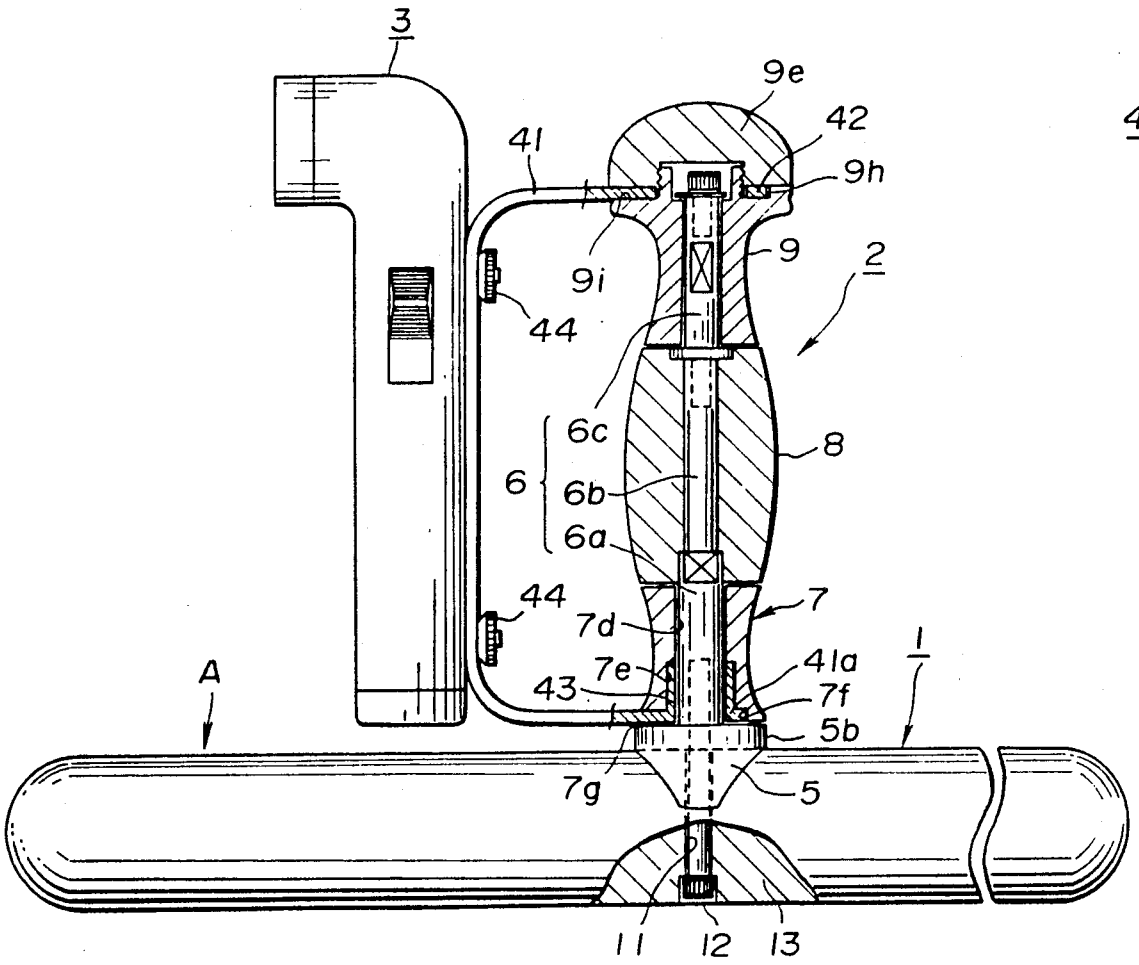

FIG. 20 (*a*) and (*b*) shows a seventh embodiment.

In this embodiment, an L-shaped flashlight 3 is mounted by way of a hand guard 41 to a crosshandle 2.

The hand guard 41 is made, for example, of metal or plastic material formed substantially in a C-shaped configuration as shown in FIG. 20 (*b*), and has an upper end in the form of an annular upper mounting portion 42 for securing with a relatively rotational upper member 9. On the other hand, it has a lower end 41a having a cylindrical lower mounting portion 43 for securing with a relatively rotational lower member 7.

On the other hand, in the crosshandle 2, there are formed a hand guard mounting hole 7e with an enlarged inner diameter so as to engage the outer cylindrical diameter of the lower mounting portion 43 of the hand guard 41, a recessed groove 7f and a side opening 7g for the recessed groove 7f for fitting the lower end 41a of the hand guard in the lower portion of the through hole 7d of the relatively rotational lower member 7. Further, an annular recessed groove 9h and an opening 9i therefor like that those shown in FIG. 5 are disposed to the upper surface of a relatively rotational upper member 9.

The lower mounting portion 43 of the hand guard 41 is fit in the hand guard mounting hole 7e of the relatively rotational lower nmember 7 of the crosshandle 2 and the lower end 41a is fit to the recessed groove 7f and the side opening 7g. The upper mounting portion 42 of the hand guard 41 is fit and mounted to the annular recessed groove 9h and the opening 9i therefor of the relatively rotational upper member 9.

In this way, the hand guard 41 secured to the relatively rotational lower member 7 and the relatively rotational upper member 9 of the crosshandle 2 are relatively rotatable to the baton main body 1 being independent of the rotation of the baton main body 1 and always points the substantially indentical direction with that of the knuckle of the gripping hand. Accordingly, the L-shaped flashlight 3 secured to the hand guard 41 by means of setting screws 44 also has a directionality to an opponent like that in each of first through sixth embodiments described above. This embodiment can provide a merit of protecting the gripping hand of the police baton user.

In the case of an upper rotational type in which the crosshandle 2 has no relatively rotational lower member 7, the lower end 41a of the hand guard 41 may be formed into an annular shape of a size capable of loosely fitting around the cylindrical circumferential side 5b of the mounting base 5.

EXAMPLE 8

Figure 21:
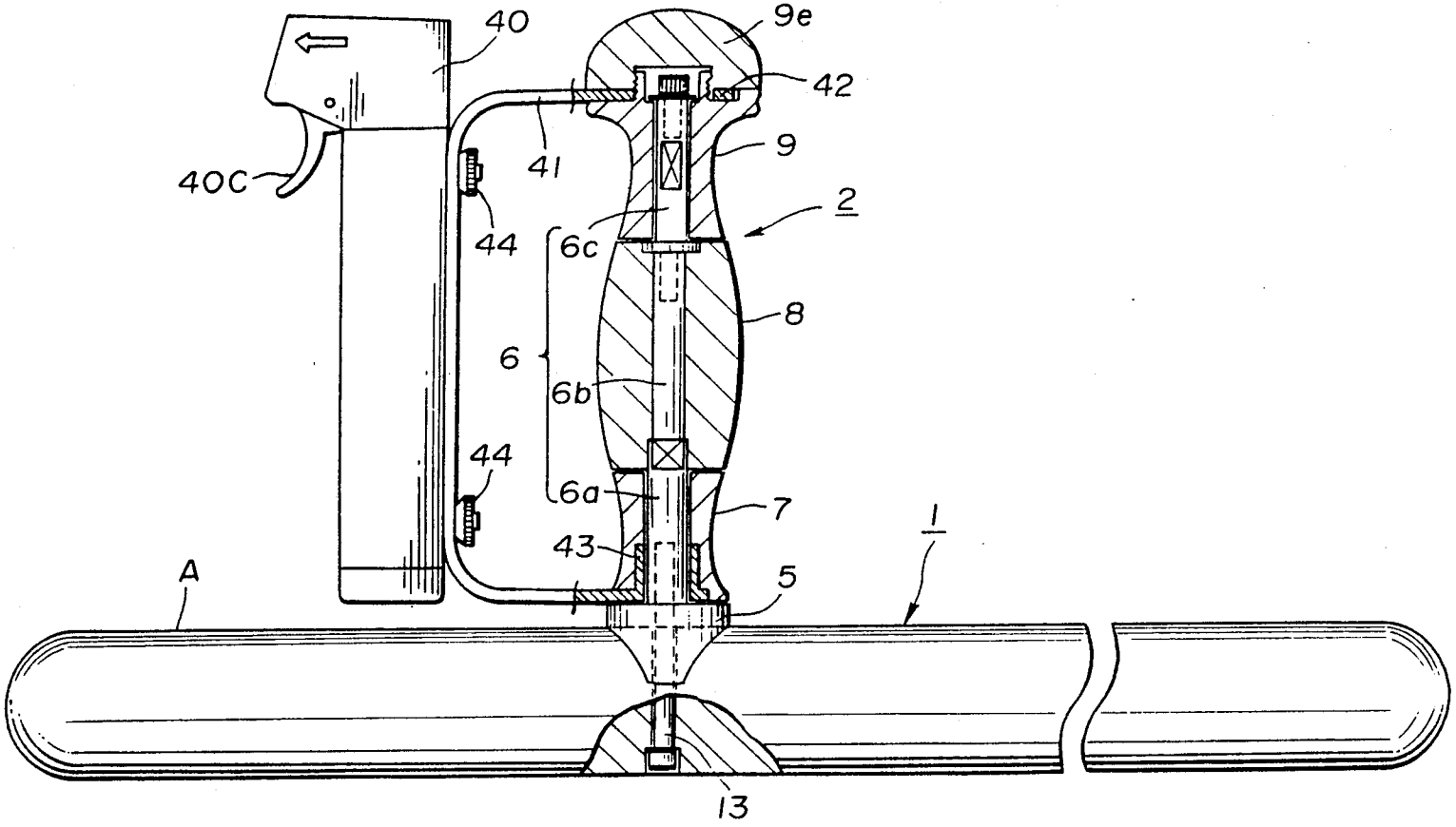
FIG. 21 is a side elevational view partially in vertical cross section of an eighth embodiment according to the present invention.
Figure 22:
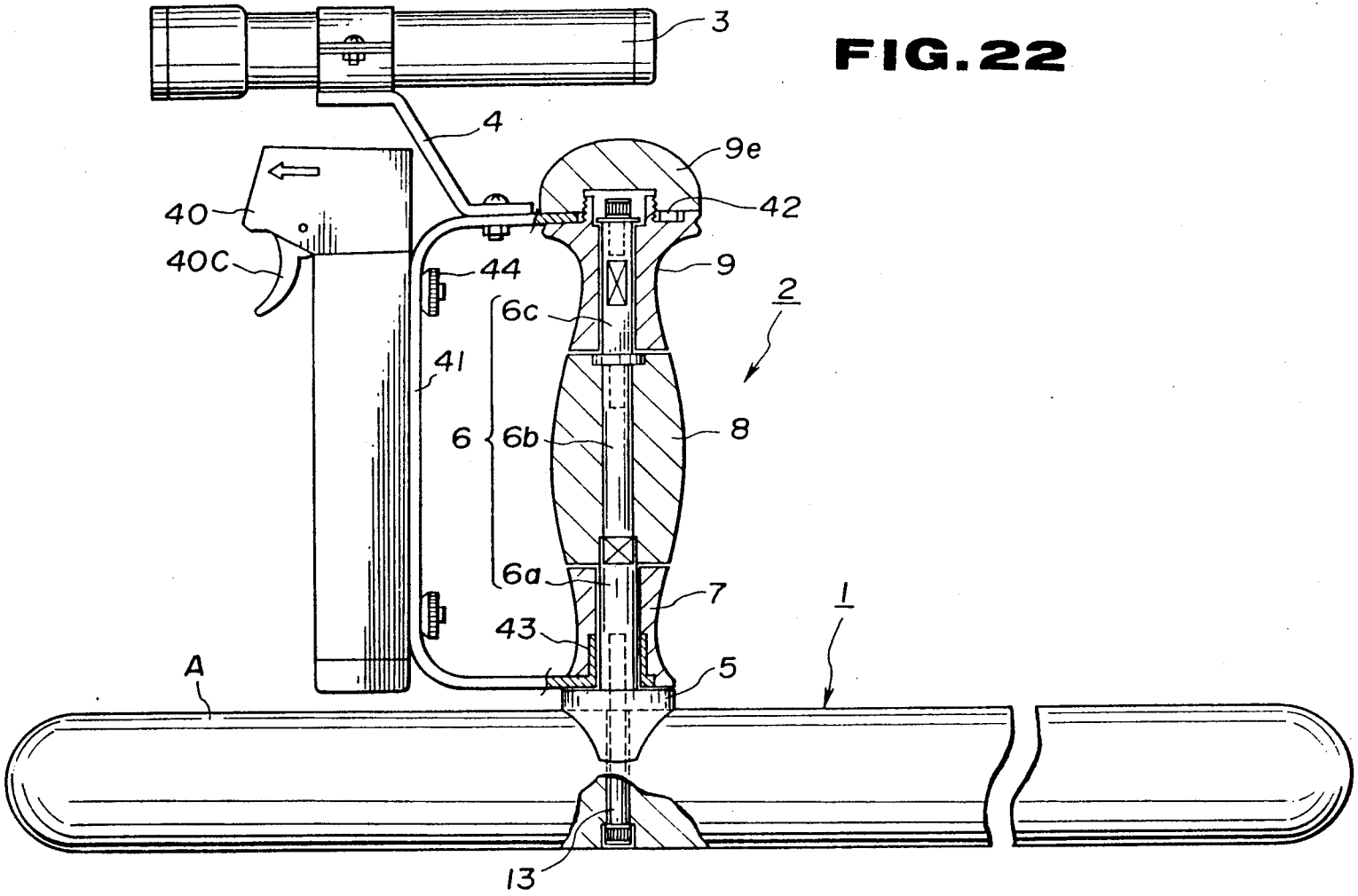
FIG. 22 is a side elevational view partially in vertical cross section of a ninth embodiment according to the present invention.

FIG. 21 shows an eighth embodiment. In this embodiment, an L-shaped tear gas shooting device 40 is mounted instead of the flashlight 3 in the seventh embodiment described above.

EXAMPLE 9

FIG. 21 shows a ninth embodiment.

In this embodiment, the eighth embodiment having the L-shaped tear gas shooting device 40 mounted by way of the hand guard 41 further has a flashlight 3 mounted by way of a mounting member 4 (with the ring-like base 4c being removed). This embodiment can provide a merit capable of repressing even a criminal hiding a weapon in the dark further easily by freely manipulating the police baton while illuminating the opponent at night and, further, spraying the tear gas as required.

EXAMPLE 10

Figure 23:
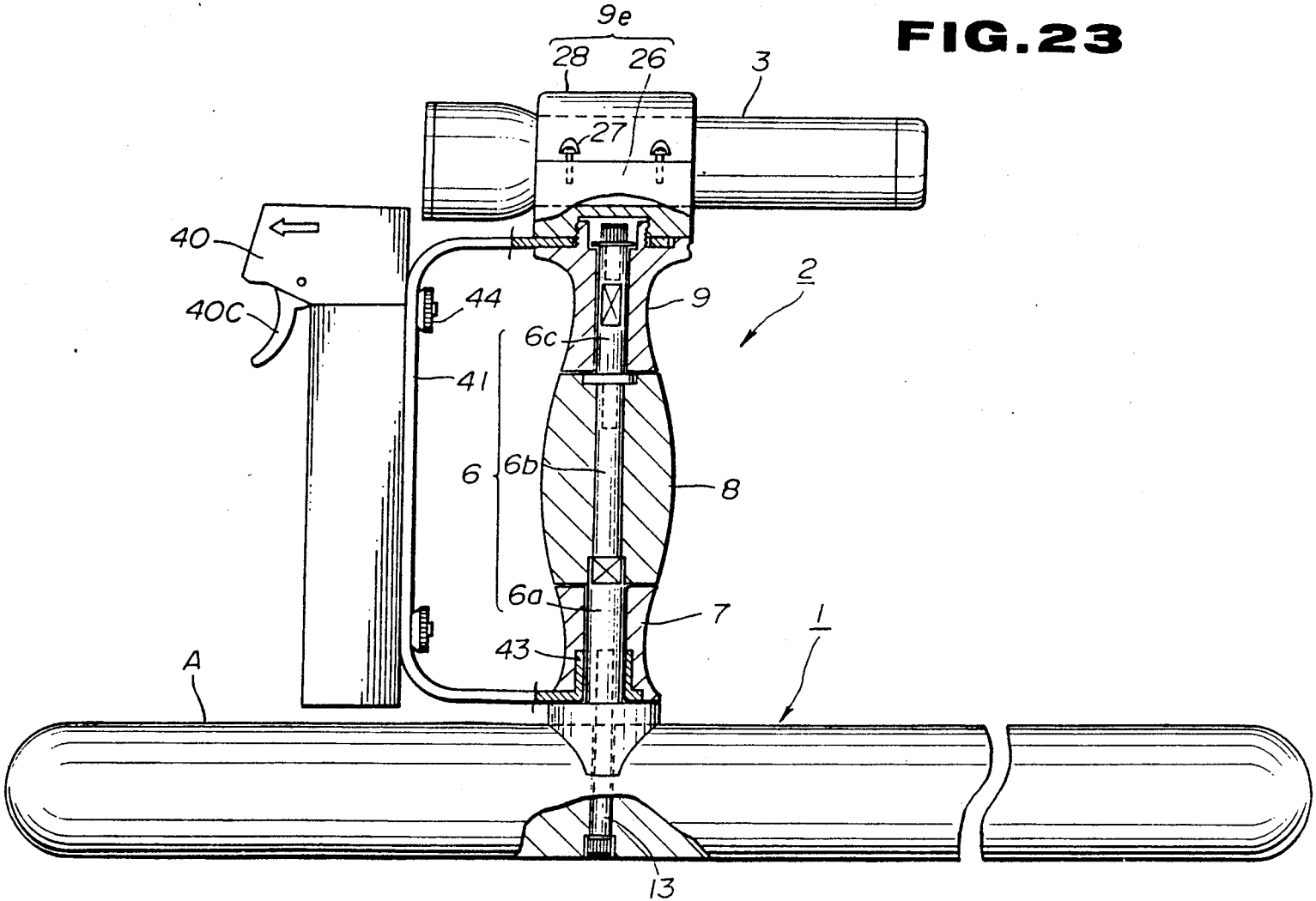
FIG. 23 is a side elevational view partially in vertical cross section of a tenth embodiment according to the present invention.

A tenth embodiment shown in FIG. 23 uses a flashlight 3 and a tear gas shooting device 40 together like that the ninth embodiment described above. The mounting structure for the flashlight 3 is different in that it is mounted directly to a cap 9*e* of a relatively rotational upper member 9 of a crosshandle 2. That is, the cap 9*e* comprises, like that the second embodiment (refer to FIGS. 9 and 10), a square cylindrical cap main body 26 and a saddle-shaped mounting member 28 detachably screw-coupled over the cap main body 26 means of four setting screws 27.

In this case although the cost for the cap 9*e* is somewhat increased as compared with that of the ninth embodiment, the support for the flashlight 3 is more stabilized and there is also a merit capable of reducing the height and making the structure compact.

EXAMPLE 11

Figures 24, 25:
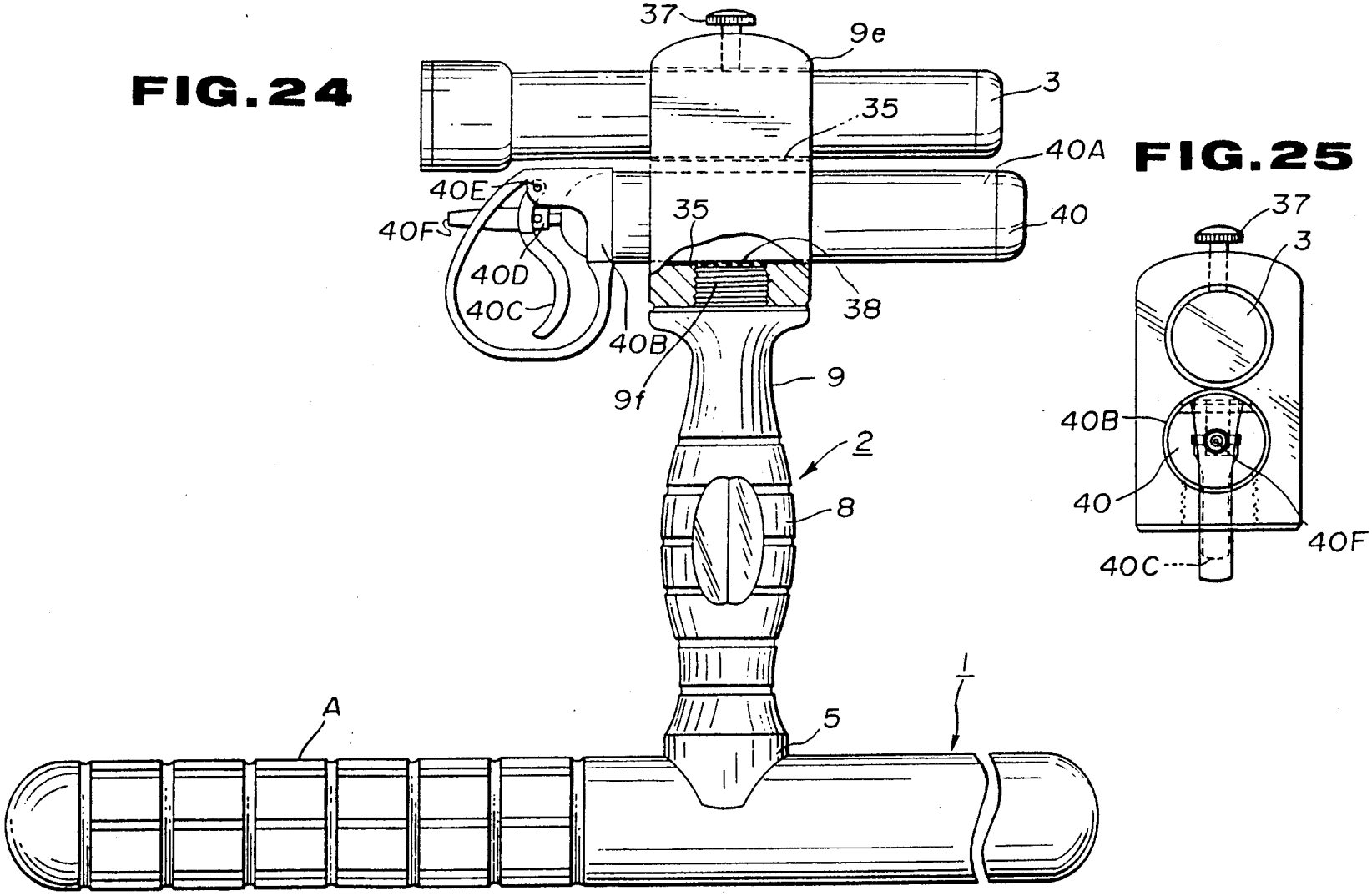
FIG. 24 is a side elevational view partially in across section of an eleventh embodiment according to the present invention.
FIG. 25 is a front elevational view of a cap shown in FIG. 24.

An eleventh embodiment shown in FIGS. 24 and 25 uses a flashlight 3 and a tear gas shooting device together. In this embodiment, both of the flashlight 3 and the tear gas shooting device 40 each in straight structure are mounted directly in parallel one above the other to a cap 9*e* of a relatively rotational upper member 9.

The cylindrical cap 9*e* has such a structure of combining that in the fourth embodiment (refer to FIGS. 14 and 15) and that in the fifth embodiment (refer to FIGS. 16 and 17) together vertically. That is, the tear gas shooting device 40 is inserted through a through hole 36 in the lower stage of the cap 9*e* and screwing to clamp the cap 9*e* to the male thread 9*f* of the relatively rotational upper member 9, by which the device 40 is maintained by an urged cushioning rubber member 38. On the other hand, the flashlight 3 is held by being inserted through a through hole 35 in the upper stage of the cap 9*e* and by clamping a set screw 37. This embodiment is also effective especially for easily repressing an atrocious criminal at night.

Instead of holding the flashlight 3 and the tear gas shooting device 40 in parallel one above the other, they may be maintained in parallel side by side.

EXAMPLE 12

Figure 26:
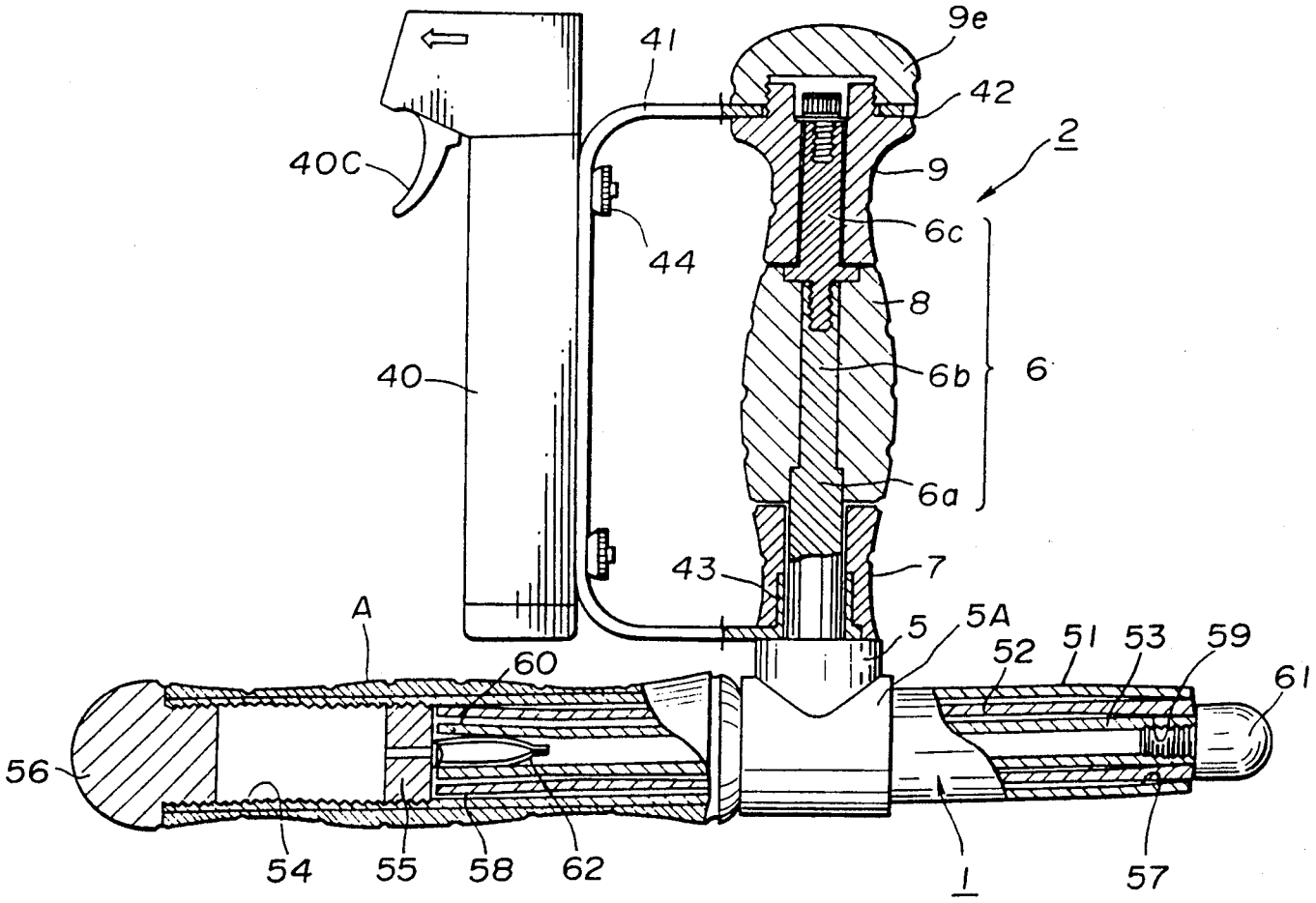
FIG. 26 is a side elevational view partially in vertical cross section of a twelfth embodiment according to the present invention.
Figure 27:
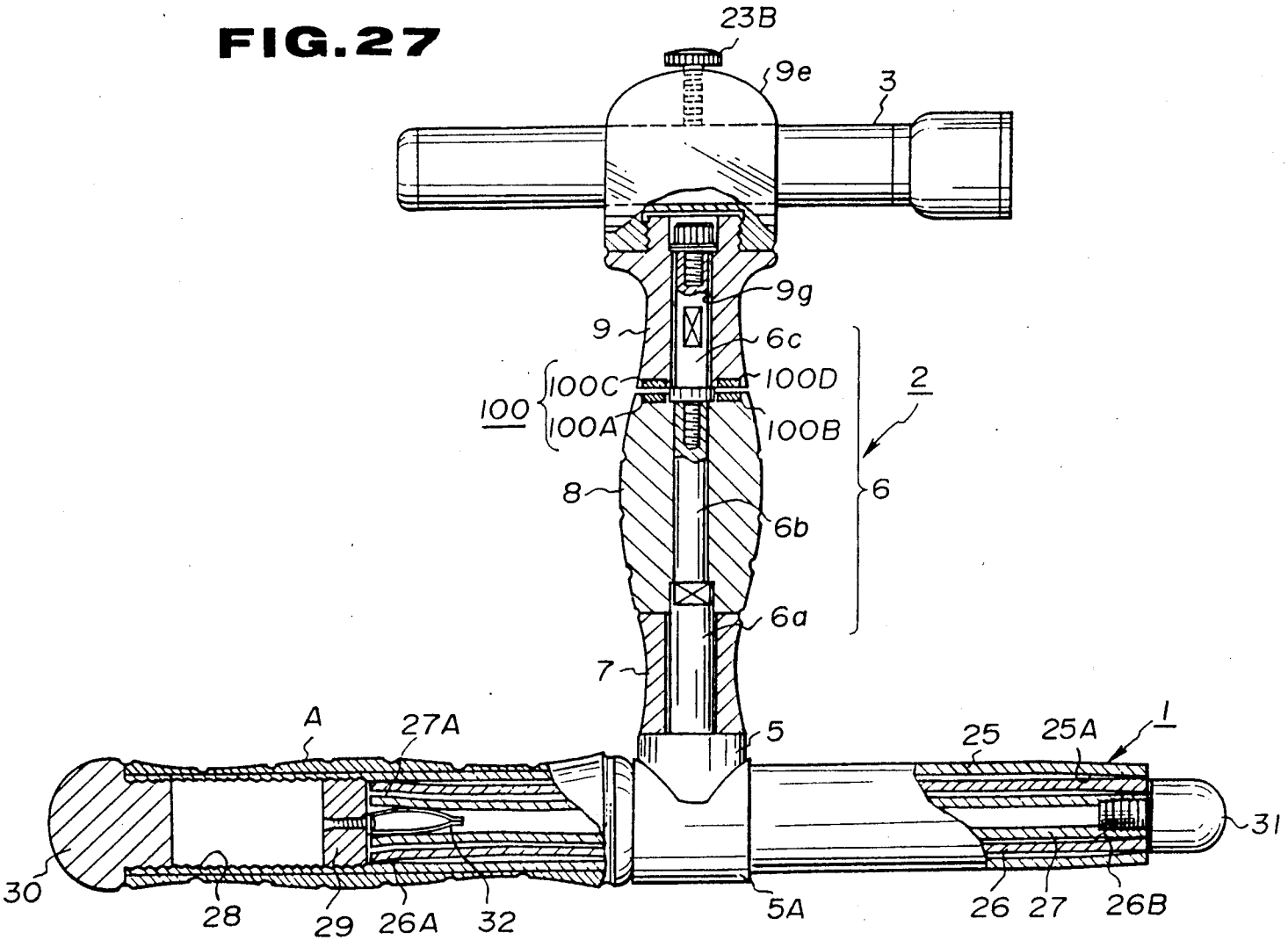
FIG. 27 is side elevational view partially in vertical cross section of a 13th embodiment according to the present invention.

FIG. 26 shows a twelfth embodiment. This embodiment is different from the eighth embodiment (refer to FIG. 21) in that the structure of a baton main body 1 is made telescopic and the mounting structure of a crosshandle 2 to the baton main body 1 is made as a plug-in type. That is, a base 5 for a shaft 6 of the crosshandle 2 is formed integrally with a cylindrical portion 5A, and the cylindrical portion 5A is fixed to the baton main body 1 by such means as shrink fit under heating, bonding or welding.

Referring to the baton main body 1 of this embodiment, it is of a telescopic type comprising a plurality (three in this embodiment) of cylindrical members 51, 52 and 53 each having different diameter. The outer cylinder 51 of the greatest diameter has a female thread 54 formed on the side of the rear end at the inner circumferential surface from the opening toward the axial inside. It also has a plug 55 having an outer circumferential thread and screw-coupled to the axial inside thereof and a cap 56 screw-coupled to the opening at the rear end. The top end of the outer cylinder 51 has an inclined surface 57 at least at the inner surface and the inner diameter is slightly reduced toward the opening at the top end. The intermediate cylinder 52 contained at the inside of the outer cylinder 51 has an inclined surface 58 on the side of the rear end at least at the outer surface, and the outer diameter is slightly enlarged toward the opening at the rear end. The inclined surface 58 engages the inclined surface 57 formed at the inner surface of the opening at the top end of the outer cylinder 51. Further, the top end of the intermediate cylinder 52 has an inclined surface 59 formed at least at the inner surface thereof and the inner diameter is slightly reduced toward the opening of the top end. The inner cylinder 53 contained at the inside of the intermediate cylinder 52 has a inclined surface 60 formed at least at the outer surface on the side of the rear end and the outer diameter thereof is slightly enlarged toward the opening of the rear end. The inclined surface 60 engages the inclined surface 59 at the inner surface of the opening at the top end of the intermediate cylinder 52. A female thread is formed to the inner surface of the opening at the top end of the inner cylinder 53 and a cap 61 is screw-coupled thereto. Further, the inner cylinder 53 engages at its rear end to a forked spring 62 screw-coupled to the plug 55.

In a state where each of the cylinders 51, 52 and 53 is contained successively as shown in FIG. 26, when a rotating force is applied to the baton main body 1, for example, by gripping the crosshandle 2, the intermediate cylinder 52 and the inner cylinder 53 are delivered and extended outwardly by a centrifugal force. In this case, the inclined surface 58 at the rear end of the intermediate cylinder 52 delivered from the outer cylinder 51 firmly engages the inclined surface 57 at the top end of the outer cylinder 51. Further, inclined surface 60 at the rear end of the inner cylinder 53 delivered from the intermediate cylinder 52 firmly engages the inclined surface 59 at the top end of the intermediate cylinder 52 and is inhibited from slipping out. The angle of inclination for each of the inclined surface 57, 58, 59 and 60 is set such that the engagement between each of the inclined surfaces is released and they can be contracted into the state shown in FIG. 26 by applying an external force greater than a predetermined level in the opposite direction to the top end of the baton main body 1 in the extended state. It is designed such that the base of the cap 61 at the top end of the inner cylinder 53 has a size large enough to retain the top end of the intermediate cylinder 52 and the forked spring 62 has a resiliency strong enough to prevent the intermediate cylinder 52 and the inner cylinder 53 from accidentally slipping off by a small force (for instance, a force slightly greater than the own weight of both of the cylinders 52 and 53). However, the anti-slip mechanism is not necessarily restricted to the forked spring 62 but a spring of other shape or a magnet may be used. Further, since the baton main body 1 in this twelfth embodiment is telescopic in the structure, the intermediate cylinder 52 and the inner cylinder 53 are can be enhoused within the outer cylinder 51 in an ordinary state as shown in FIG. 26 and the police baton is convenient to carry about, for example, by being placed in a holster and put on the side of a user's waist like that a hand gun.

Further, in a case where the baton main body 1 of the police baton with crosshandle is contained in the holster and it is suspended from the right side of the waist with the crosshandle 2 being directed horizontally, the guard 41 mounted with the flashlight 3 is spontaneously directed downward by its own weight. Accordingly, the user can perform a unique method of using the police baton by swiftly gripping th crosshandle 2 by his right hand at any time with no hindrance of the hand guard 41 and turning back his wrist to quickly project the intermediate cylinder 52 and the inner cylinder 52 while drawing out the baton main body 1 from the holster, that is, a so-called "quick draw." In a case of suspending the holster from the left side of the waist, the police baton is contained in the holster with the crosshandle 2 being directed substantially rearward and horizontally. Upon drawing police the baton, it is drawn out from the holster by gripping the crosshandle 2 by the right hand while inducing the baton main body 1 to the horizontal direction by the left hand and it is then thrusted to project the intermediate cylinder 52 and the inner cylinder 53 in a moment. If the user gets accustomed to such maneuvers, even if an opponent comes nearer with a weapon such as a hand gun at the ready, it is possible to instantly sweep off the weapon or blow a tear gas or the like.

In each of the embodiments described previously, the relatively rotational upper member 9 is attached to the top end 6*b* of the shaft 6 by screw-coupling of the bolt 18, but it is not restricted only thereto and a retainer ring, welding, bonding or like other known attaching means may also be applied.

Furthermore, structures for the grip and the shaft 6 of the crosshandle 2 may not necessarily by restricted only to those of the embodiments but various modifications are possible. For instance, fixing of the crosshandle 2 to the baton main body 1 is illustrated by a case of screw coupling with the bolt and a case of inserting the cylindrical portion of the base but other fixing means such as a retaining ring, welding, bonding or the like may also be used.

Alternatively, quite different therefrom, the baton main body 1, the static member 8 of the upper rotational type crosshandle 2 and the shaft protruded from the upper surface of the static member 8 may be formed integrally from a plastic material, and the relatively rotational upper member 9 may be fit around the protruded shaft and rotatably attached by a retaining ring.

Further, it is also possible to protrude the shaft further from above the relatively rotational upper member 9, fit a cap 9*e* having a shaft inserting hole formed to the central portion to the shaft and, subsequently, join the shaft and the cap 9*e* by welding to constitute an integral structure made of a synthetic resin.

Further, the transverse cross section in the outer circumferential surface 9*c* of the relatively rotational upper member 9 is not necessarily restricted to a circular shape but it can be in an elliptic or like other non-circular cross sectional shape so as to ensure the directionality by the feeling of the thumb and the forefinger that grips it. With such a constitution, the shooting direction for various kinds of shooting devices mounted to the relatively rotational upper member 9 can be controlled more precisely and freely with no visual confirmation.

Furthermore, as already presented by the applicant in the prior application, the top end of the baton main body 1 may be made hollow and granular or rod-like weight may be charged to the top end of the baton main body to increase the impact shock of the rotating baton main body 1 both in the case of the telescopic type, as well as of the non-telescopic type.

EXAMPLE 13

FIG. 27 through FIG. 31 illustrate a 13th embodiment.

In this embodiment, a static member 8 is fixed to a shaft 6 by inserting an intermediate portion 66 of the shaft 6 into the static member 8 and engaging the lower end of the shaft 6 to a base end 6*a*. Further, a relatively rotationally upper member 9 is rotatably fit loosely around the top end 6*c* of the shaft 6. The upper end (free end) of the static member 8 and the lower end of the relatively rotational upper member 9 are opposed with a slight gap to each other and each of permanent magnets 100 is attached in a face-to-face relationship as described later to each of the end face at the free end of the static member 8 and to the lower end face of the relatively rotational upper member 9.

Figure 28:
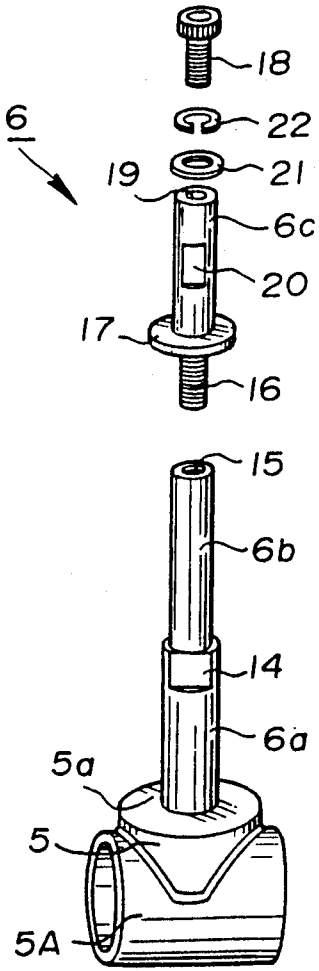
FIG. 28 is an exploded perspective view of the crosshandle shaft shown in FIG. 27.
Figure 33:
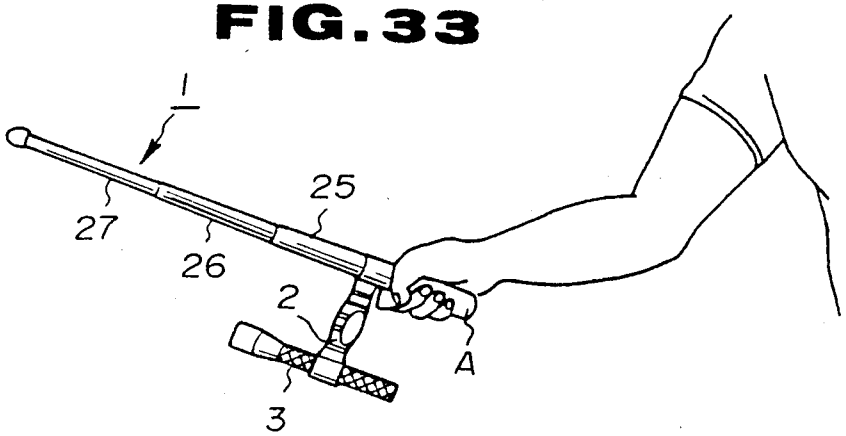
FIGS. 32, 33 and 34 are, respectively, views for illustrating modes of using the police baton with crosshandle shown in FIG. 27.

Description will now be made more in details, further to this embodiment with reference to exploded perspective views of FIG. 28 and FIG. 29. A mounting base 5 of the shaft 6 has a saddle-shaped lower end, to which a cylindrical portion 5A is welded integrally with the outer circumferential surface being in an intimate contact therewith. The cylindrical portion 5A is fixed to the baton main body 1 by means of shrink fit under heating, bonding, welding or the like, and it is inserted from one end of the baton main body 1, enforced into a predetermined position and then firmly fit to the baton main body 1. Subsequently, the gripping haft A is inserted and attached to the baton main body 1.

Other structures for the shaft 6 are substantially the same as those in Example 1 already described with reference to FIG. 4 and explanations therefor are omitted.

Figure 29:
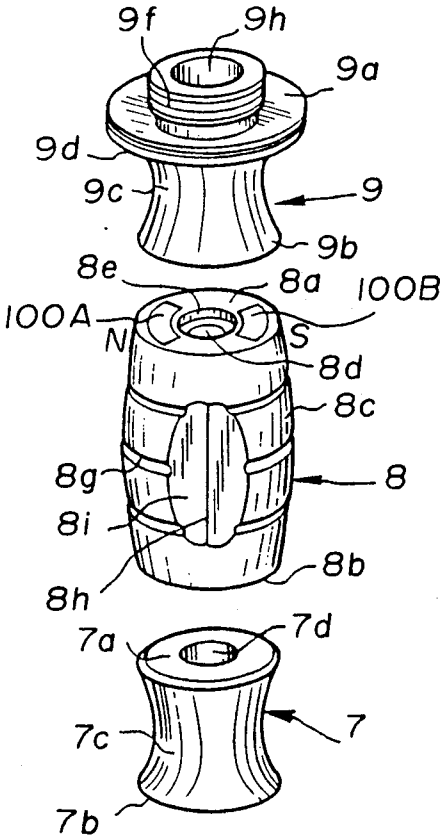
FIG. 29 is an exploded perspective view of a grip of the crosshandle shown in FIG. 27.

FIG. 29 is an exploded prespective view for a grip in this embodiment. Since almost of the structure is identical with that in the first embodiment, explanation will be made only to the portions different from those in Example 1.

Permanent magnets 100A and 100B each of a flat and fan-like shape are embedded to the upper surface 8*a* (free end) of a static member 8 is symmetrical with respect to a recess 8*e*. Both of the magnets 100A and 100B are so constituted that the outer circumferential sides of them have polarities opposite to each other. In this embodiment, the outer circumferential side of the magnet 100A has an N pole (accordingly, the inner circumferential side has an S pole) while the outer circumferential side of the magnet 100B has an S pole (accordingly, the inner circumferential side has an N pole). Although the two magnets 100A and 100B are disposed linearly along with the axis of the baton main body 1, the number of the permanent magnets may not necessarily be two but they may be disposed by any larger number. Further, the shape of the magnet may not necessarily be restricted to the fan-like shape and their arrangement may not always be linear.

Description will now be made to the portion of the relatively rotational upper member 9.

Figure 30:
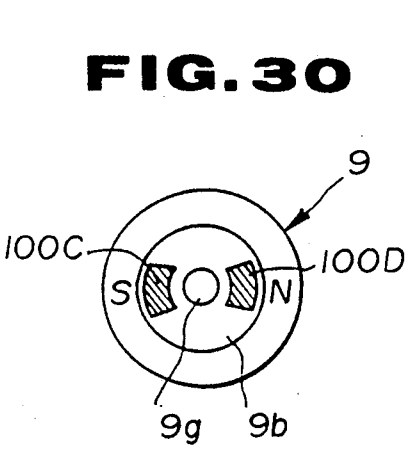
FIG. 30 is a bottom view of a relatively rotational upper member shown in FIG. 29.

As shown in FIG. 30, permanent magnets 100C and 100D each of a flat and fan-like shape are embedded to the lower surface 9*b* of the relatively rotational upper member 9 in symmetrical with the through hole 9*g* of the shaft 6. Both the magnets 100C and 100D are corresponded to the magnets 100A and 100B attached on the side of the static member 8 respectively and disposed such that the magnet 100C and the magnet 100A constitute a pair attracting to each other, while the magnet 100D and the magnet 100B constitute a pair attracting to each other. In this embodiment, the outer circumferential side of the magnet 100A has the N pole, while the outer circumferential side of the magnet 100C has the S pole. Further, the outer circumferential side of the magnet 100B has the S pole, while the outer circumferential side of the magnet 100D has the N pole. When the magnets 100C and 100D on the side of the relatively rotational upper member 9 are disposed in this way corresponding to the magnets 100A and 100B on the side of the static member 8, the relatively rotatable upper member 9 rotatably fit loosely around the shaft 6 is kept from the free rotation by the magnetic attraction force.

Figure 31:
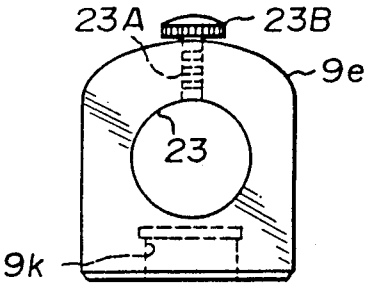
FIG. 31 is a front elevational view of a cap for the crosshandle shown in FIG. 28.

As shown in FIG. 31, an upper cap 9*e* is in a cylindrical form having a spherical top end, and a mounting hole 23 is formed diametrically through the cylinder for inserting the flashlight 3. Further, the upper cap 9*e* has a female thread bore 23A extending from its top to the mounting hole 23 and a female thread bore 9*k* engaging a male thread 9*f* for attaching the upper cap 9*e*. The flashlight 3 inserted through the mounting hole 23 is secured to the cap 9*e* by clamping a retaining screw 23B screw-coupled to the female thread bore 23A. The mounting hole 23 for the flashlight 3 is formed while considering the axial direction thereof so that the axial direction of the flashlight 3 aligns with the axial direction of the baton main body 1 in a state where the upper cap 9*e* is firmly attached to the relatively rotational upper member 9 constrained by the magnetic force of the magnets.

Upon assembling the crosshandle 2, the upper surface of a flange 17 projects slightly higher than the surface of the magnets 100A and 100B at the upper surface of the intermediate portion 6B.

The lower surface 9*b* of the relatively rotational upper member 9 abuts against the upper surface of the flange 17 of the top end 6*c* of the shaft 6 and opposes with a slight gap to the upper surface 8*a* of the static member 8. Then, a slight gap is kept between each of the opposing faces of the magnets 100A, 100B and the magnets 100C, 100D.

In this case, paired magnet 100A and the magnet 100C, as well as the paired magnets 100B and the magnet 100D in the upper surface 8*a* of the static member 8 and in the lower surface 9*b* of the relatively rotational upper member 9 attract to each other between different poles being opposed to each other, by which the relatively rotational upper member 9 is positioned by the magnetic force and the direction of the mounting hole 23 for the flashlight 3 spontaneously aligns with the axial direction of the baton main body 1.

The baton main body 1 in this embodiment is of a telescopic type and has an identical structure as that in the twelfth embodiment. This embodiment operates as described below.

Figure 32:
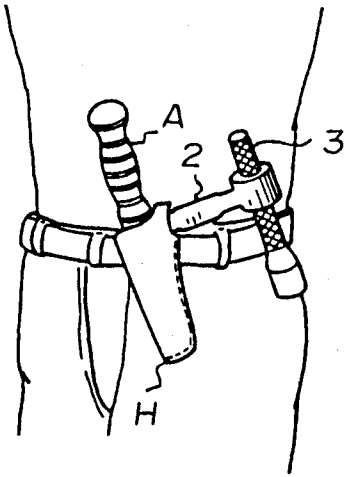

A user of the police baton with crosshandle, for example, a police man can usually carry about the police baton enhousing it in a contracted state in a holder H suspended from a waist as shown in FIG. 32. In this case, rotation of the relatively rotational upper member 9 of the crosshandle 2 is constrained by the magnetic attraction force of the permanent magnets 100 disposed at the surface opposed to the static member 8, and the shooting port of the flashlight 3 mounted to the relatively rotational upper member 9 is pointed to the top end of the baton main body 1.

In a case of using the police baton with crosshandle carried in this way, it can be manipulated just like a sword by gripping the gripping haft A at the end of the baton main body 1 or it can be manipulated so as to rotate the baton main body 1 by gripping the crosshandle 2.

Figures 37, 38:
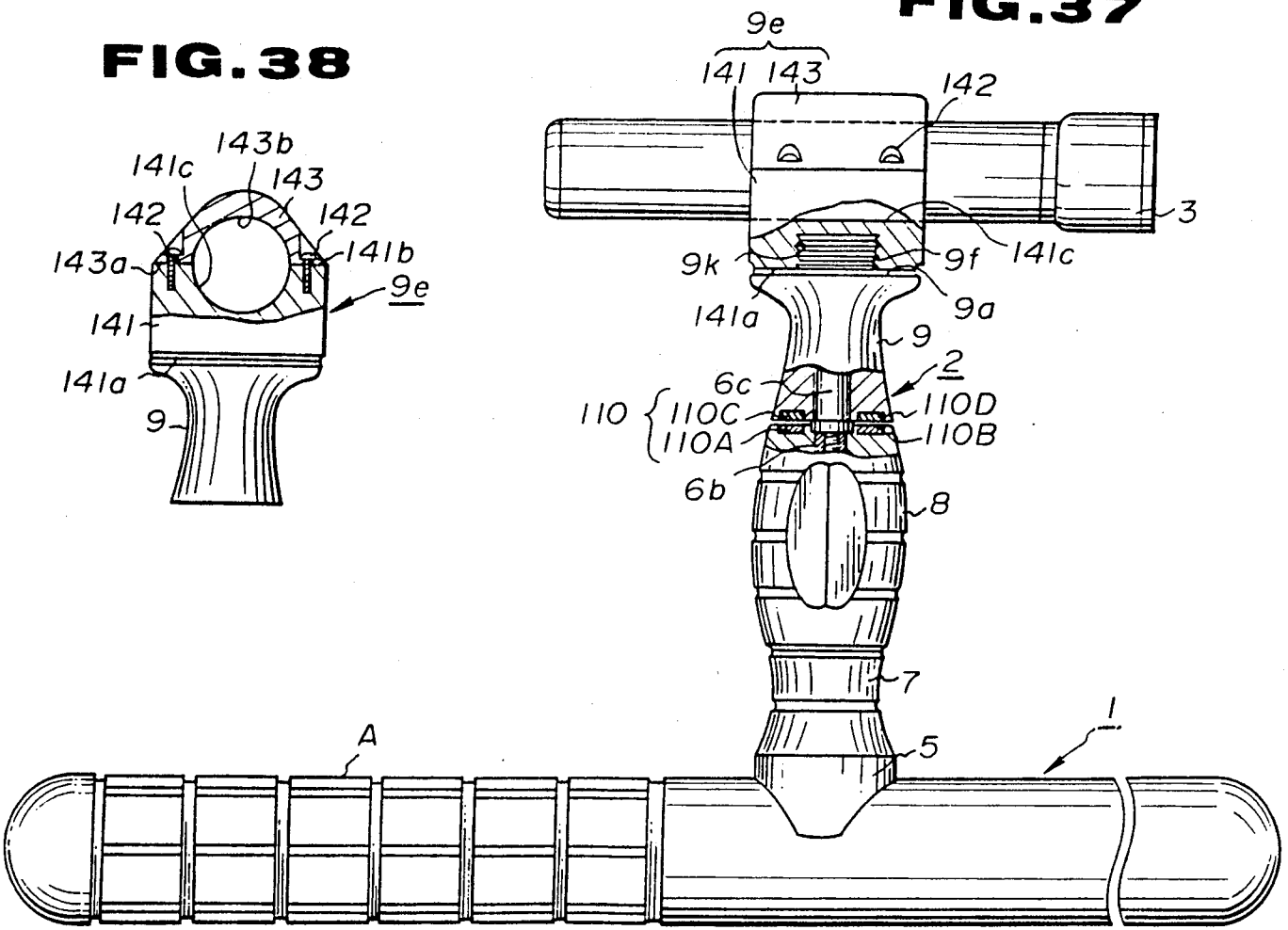
FIG. 37 is a side elevational view partially in vertical cross section of a 15th embodiment according to the present invention.
FIG. 38 is a front elevational view of a cap shown in FIG. 37.

In a case of gripping the gripping haft A, the police baton is drawn from the holder H to thrust the baton main body 1 and used by holding it in the extended state like a sword as shown in FIG. 37. The crosshandle 2 is constrained by the magnetic force of the incorporated magnets and the flashlight 3 always points the same direction as the top end of the baton main body 1 automatically. If it should touch a body upon drawing the police baton from the holder H and the flashlight 3 is forcively pointed to the opposite direction, pairing relations between the incorporated magnets 100 are changed from each other, in which the magnet 100A faces to the magnet 100D, while the magnet 100B faces to the magnetic 100C. Thus, the magnets in each pair are opposed to each other at the poles of identical polarities to exert a magnetic repulsive force. As a result, the relatively rotational upper member 9 rotates around the shaft 6 as an axis, by which the magnetic 100A faces to the magnet 100C, while the magnet 100B faces to the magnet 100D, and the pointing direction of the flashlight 3 is automatically corrected to the top end direction of the baton main body 1 under the effect of the magnetic attraction.

Accordingly, in this embodiment, it is possible to surely illuminate an opponent by the flashlight 3 also in a case of manipulation by gripping the gripping haft A at the end of the baton main body 1.

On the other hand, in a case of manipulation by gripping the crosshandle 2, it is gripped while winding the thumb and the forefinger of the gripping hand around the outer circumferential surface 9*c* of the relatively rotational upper member 9 of the crosshandle 2. The little finger is wound around the relatively rotational lower member 7 of the crosshandle 2. For rotationally manipulating the baton main body 1, rotating force is given by the movement of an arm and a wrist, while the static member 8 of the crosshandle 2 is released by loosening the gripping force other than that for the thumb, the forefinger and the little finger. The relatively rotational upper member 9 and the relatively rotational lower member 7 are gripped as they are and fixed within the hand while the static member 8, the baton main body 1 and the shaft 6 are rotated integrally around the shaft 6 as the center of rotation, overcoming the magnetic force of the incorporated magnets 100. For interrupting the rotation, the static member 8 is firmly gripped to apply a braking effect to the rotation of the baton main body 1.

During the rotational manipulation, the thumb and the forefinger firmly holding the relatively rotational upper member 9 of the crosshandle 2 are engaged by the retaining portion 9*d*. Therefore, the police baton is neither displaced downward nor slipped off the hand even if violent rotating operation is repeated.

When the baton main body 1 is caused to rotate forcively overcoming the magnetic force of the magnets 100 by firmly gripping the relatively rotational upper member 9 while releasing the static member 8 of the crosshandle 2, the flashlight 3 mounted to the relatively rotational upper member 9 is always independent of the rotating movement of the baton main body 1 and the static member 8 of the crosshandle. That is, the flashlight 3 can be pointed substantially in the same direction as that of the knuckle of the gripping hand irrespective of the rotating manipulation to the baton main body 1 given by the gripping of the crosshandle 2.

Figure 34:
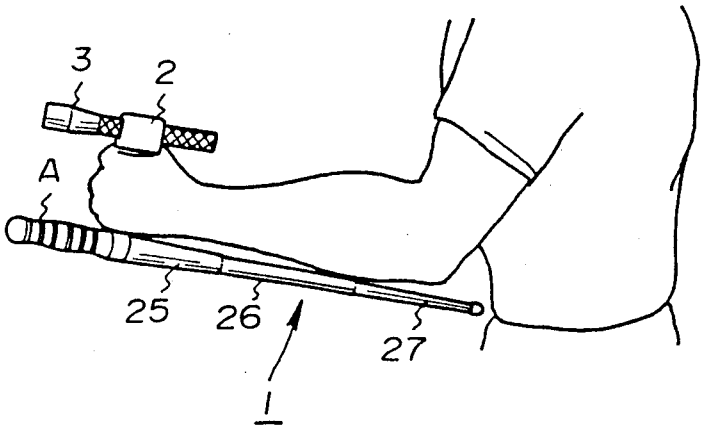

FIG. 34 shows one example for the mode of using this police baton having such features. For instance, when a police man checks up an opponent in the dark, he draws the police baton with crosshandle from the holder H, previously extends the baton and lights up the flashlight 3 while gripping the crosshandle 2 and directing the top end of the gripping haft A of the baton main body 1 to the opponent. Then, it is possible to illuminate the opponent straight forward. Since the magnetic repulsive force is caused in the incorporated magnets 100 when the shooting port of the flashlight 3 is directed to the top end of the gripping haft A, both of the static member 8 and the relatively rotational upper member 9 of the crosshandle 2 are tightly gripped so that the baton main body 1 is not rotated.

When the police baton is held as shown in FIG. 34, since the baton main body 1 on the opposite side of the gripping haft A comes under the arm, there is no disadvantage of giving unnecessary threatening impression on the opponent. In addition, if he is suddenly attacked by the opponent by a weapon or the like, he can instantly sweep off the opponent's weapon be swiftly thrusting the arm that grips the crosshandle 2 forward thereby rotating the baton main body 1. Since the flashlight 3 is pointed to the opponent also during this manipulation, there is no worry of missing the opponent by this counter attack operation. At the same time, since the police man can take freely manipulate the crosshandle 2 while taking a step forward and breaking the opponent's balance by the other hand, he can hit and down the opponent by rotating the baton main body 1 and thrust and down the opponent by the end of the baton by thrusting the baton main body 1 straight forward while surely catching the opponent under the light of the flashlight 3. In this way, there is no worry of giving unnecessary threatening or warning impression on the opponent and can cope with sudden change of the situation.

Further, in the rotating manipulation of the baton main body 1 by the grip of the crosshandle 2, since the longer diameter of the non-circular cross section of the static member 8 of the crosshandle 2 is always aligned with the axial direction of the baton main body 1, and the direction along which the magnetic force of the magnets 100 incorporated in the static member 8 and the relatively rotational upper member 9 becomes greatest is aligned with the axial direction of the baton main body 1, the pointing direction of the baton main body 1 can be controlled extremely easily by the feeling of the hand that grips the static member 8 under rotation together with the baton main body 1 even in such a situation where the visual confirmation is difficult, for instance, at night.

Further, it is also easy to apply a braking effect on the rotation of the static member 8 or the rotation of the baton main body 1 to abruptly stop rotation by firmly gripping the gripping surface 8*i* chamfered into an angled shape at the outer circumferential surface 8*c* of the static member 8, so that even a beginner can easily manipulate the police baton.

Description will then be made to other embodiments. In each of the following embodiments, identical or corresponding portions carry the same reference numerals and duplicate explanation will be omitted.

EXAMPLE 14

Figures 35, 36:
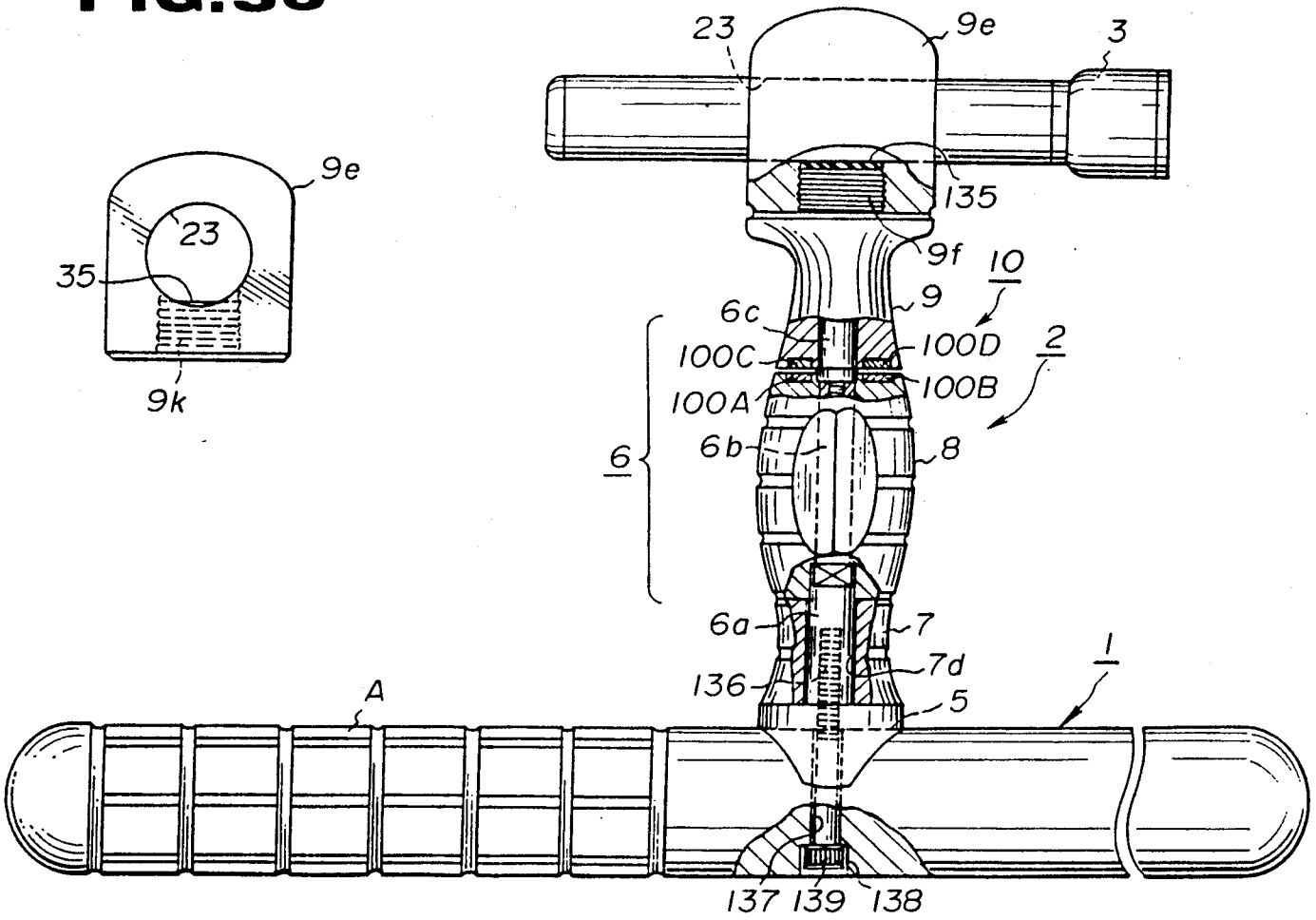
FIG. 35 is a side elevational view partially in vertical cross section of a 14th embodiment according to the present invention.
FIG. 36 is a front elevational view of a cap shown in FIG. 35.

FIG. 35 and FIG. 36 show a 14th embodiment.

In this embodiment, the mounting structure of a flashlight 3 and the structure of a baton main body 1 are different from the first embodiment described above. That is, the outer shape of a cap 9*e* for a relatively rotational upper member 9 of a crosshandle 2 is substantially identical with that of the 13th embodiment described above, but a female threaded bore 9*k* in the cap 9*e* is formed so as to be in communication with a through hole 23 for the flashlight 3. Then, a cushioning rubber member 135 is inserted in the female thread bore 9*k*. In a case of mounting the flashlight 3, the flashlight 3 is inserted through the through hole 23 of the cap 9*e*, and the cap 9*e* is screwed and clamped to the male thread 9*f* of the relatively rotational upper member 9. Thus, the cushioning rubber member 135 is urged between the circumference of the flashlight 3 and the end face of the male thread 9*f* of the relatively rotational upper member 9 to fix the flashlight 3 to the cap 9*e*. This can provide a merit that the setting screw 23*b* for fixing the flashlight 3 is no more necessary.

In the crosshandle 2, magnets 100 are incorporated like that in the 13th embodiment, in which magnets 100A and 100B on the side of a static member 8 are paired, respectively, with magnets 100C and 100D on the side of the relatively rotational upper member 9, so that the flashlight 3 is automatically pointed to the top end direction of the baton main body 1 by the magnetic attraction force in the state where the crosshandle 2 is set free.

Referring to the baton main body 1, it is a nontelescopic single rod member in this embodiment. The crosshandle 2 is secured by means of a bolt at a predetermined position of the baton main body 1. That is, an axial threaded bore 136 is formed in the lower portion of a base end 6*a* of a shaft 6. On the other hand, a radially passing bolt insertion hole 137 and a spot facing 138 are disposed at a predetermined position on the circumferential side of a baton main body 1. The mounting base 5 and the base end 6*a*of the shaft 6 are fixed to the baton main body 1 by mating the mounting base 5 of the shaft 6 to the outer circumferential surface of the baton main body 1 at which the bolt insertion hole 137 is opened and by screw-coupling and clamping the bolt 139 that is inserted from the side of the spot facing 138 into the threaded bore 136 in the base end 6*a* of the shaft 6.

Also in this embodiment, when it is manipulated by the grip of the gripping haft A, the flashlight 3 always point automatically the same direction as the top end of the baton main body 1.

EXAMPLE 15

FIG. 37 and FIG. 38 show a 15th embodiment.

In this embodiment, the mounting structure of a flashlight 3 is different from that in the 14th embodiment. That is, a cap 9*e* for a relatively rotational upper member 9 of a crosshandle 2 comprises a square cylindrical cap main body 141 and a saddle-shaped mounting member 143 detachably screw-coupled over the cap main body 141 by means of four setting screws 142. The cap main body 141 has a circular lower surface 141*a* corresponding to the upper surface 9*a* of the relatively rotationally upper member 9 and a female thread 9*k* formed at the central portion thereof for engaging a male thread 9*f* of the relatively rotational upper member 9. Further, an upper surface 141*b* of the cap main body 141 has a semi-circular recessed groove 141*c* for receiving the flashlight 3. On the other hand, a lower surface 143*a* of the mounting member 143 has a semi-circular recessed groove 143*b* which corresponds to the recessed grooved 141*c* of the cap main body 141.

The flashlight 3 is fit in the recessed groove 141*c* of the cap main body 141, the mounting member 143 is placed thereover to fit the flashlight 3 with the recessed groove 143*b*, and then the setting screws 142 are clamped to firmly secure the flashlight 3. The shooting port of the flashlight 3 is disposed so as to point the same direction as the top end of the baton main body 1.

In the crosshandle 2 of this embodiment, magnets 100 are incorporated like that in each of the 13th and 14th embodiments, in which magnets 110A and 110B on the side of the static member 8 paired with magnets 110C and 110D on the side of the relatively rotational upper member 9, and the direction of the relatively rotational upper member 9 and thus the direction of the flashlight 3 is controlled by the magnetic attraction force. That is, in a case of manipulating the baton main body 1 by the grip of the gripping haft A, the flashlight 3 always points the same direction as that for the top end of the baton main body 1 automatically by the magnetic force of the magnets 110 incorporated in the crosshandle 2.

There are merits that the flashlight 3 is firmly mounted, and the attachment for the flashlight 3 is not loosened by repeating the manipulation method of controlling the pointing direction of the flashlight 3 with the magnetic force of the magnets 110 while gripping the gripping haft A.

EXAMPLE 16

Figure 39:
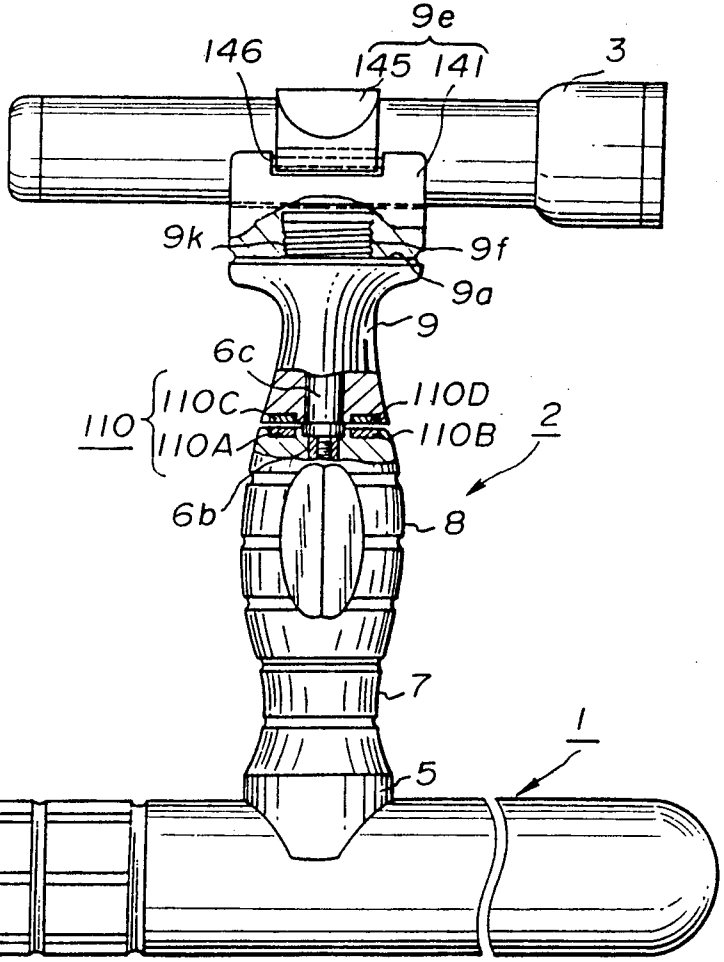
FIG. 39 is a side elevational view of a 16th embodiment according to the present invention.
Figure 40:
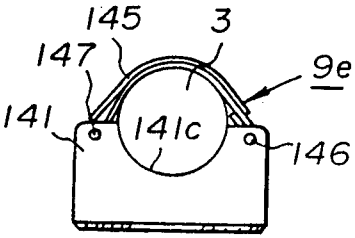
FIG. 40 is a front elevational view of a cap shown in FIG. 39.
Figure 41:
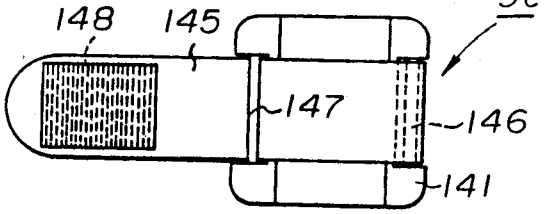
FIG. 41 is a plan view of the cap shown in FIG. 40 with a portion being turned open.

FIG. 39 through FIG. 41 show a 16th embodiment.

In this embodiment, a rubber band 145 is used instead of the saddle-shaped mounting member 143 which is a constituent portion of the cap 9*e* in the 15th embodiment described above. One end of the rubber band 151 is wound around and secured to one shaft 146 fixed to the upper side of a cap main body 141. The other end of the rubber belt 145 is made as a free end. The free end is passed around the other shaft 147 secured to the opposite upper side of the cap main body 141, and then turned back and fastened with a magic tape 148. In this way, the flashlight 3 fit into a recessed groove 141*c* of the cap main body 141 is retained and fixed by the rubber belt 145. This can provide a merit that the flash lamp 3 can be attached and detached in one tough operation. Furthermore, the cap 9*e* that supports the flashlight 3 is light in weight as compared with each of the embodiments and, accordingly, there is a merit capable of controlling the pointing direction of the flashlight 3 easily even if the magnetic force of the magnets 110 incorporated in the crosshandle 2 is relatively small.

Instead of retaining with the magic tape 148, a hook may be secured to the free end of the rubber band 145, and the hook may be engaged and retained on the other shaft 146.

EXAMPLE 17

FIG. 42 through FIG. 44 show a 17th embodiment.

In this embodiment, a flashlight 3 is mounted by way of a mounting member 150 to a relatively rotational upper member 9 of a crosshandle. The mounting member 150 comprises a axially bisected tubular holding portion 150*a*, clamping screws 150*b* for joining them, an arm 150*c* and a ring-shaped base 150*d*. On the other hand, as shown in FIG. 44, an upper surface 9*a* of a relatively rotational upper member 9 has an engaging groove 9*m* and a grooved opening 9*n* formed around the base of a female thread 9*f* for receiving the ring-shaped base 150*d* of the mounting member 150. The opening direction of the grooved opening 9*n* is aligned with the direction of arranging both of magnets 110C and 110D mounted to a lower surface 9*b* of the relatively rotational upper member 9.

The mounting member 150 is assembled to the relatively rotational upper member 9 by fitting the ring-shaped base 150*d* of the mounting member 150 into the engaging groove 9*m*, fitting the arm 150*c* to the grooved opening 9*n* and then screw-coupling and clamping the cap 9*e* of the relatively rotational upper member 9 to the male thread 9*f*. The flashlight 3 is inserted into the holding portion 150*a* of the mounting member 150 and secured by means of clamping screws 150*b*. In this way, the axial direction of the flashlight 3 is controlled by the magnetic force so as to align with the direction of arranging magnets 110, that is, the axial direction of the baton main body 1.

In each of the 13th through 17th embodiments, the flashlight 3 as a light shooting device is mounted to the cap 9*e* directly or indirectly by way of the mounting member 4, but a shooting device for shooting other medium may also be mounted. For instance, there can be mentioned as practical devices, for example, a flashing device for momentarily dazzling opponent's eyes with intense light, an electromagnetic wave generating device for momentarily paralyzing the moving function of an opponent by electromagnetic wave, an acoustic wave shooting device such as for generating detonating or blowing sound that threatens an opponent or supersonic wave, a device for shooting a suppressing gas such as a tear gas, a liquid shooting a device for marking a flagrant delict with paint, dye or the like, or a solid shooting device for discharging metal particles or resin beads. By mounting them alone or in combination, it is possible to falter, take a surprise or momentarily astonish an opponent, thereby making it possible to suppress the opponent more easily.

EXAMPLE 18

Figures 45, 46:
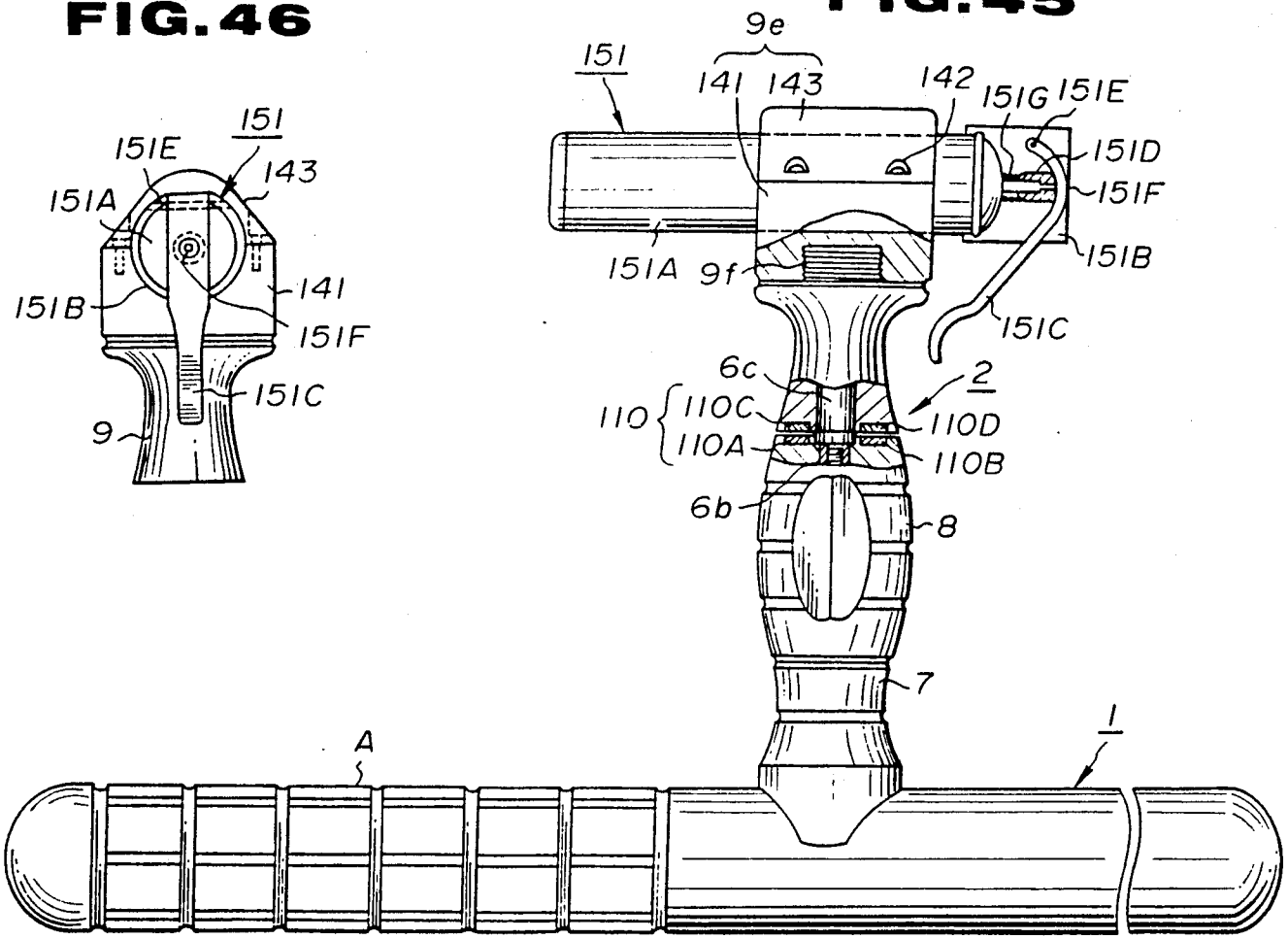
FIG. 45 is a side elevational view partially in vertical cross section of a 18th embodiment according to the present invention.
FIG. 46 is a front elevational view of a cap shown in FIG. 45.

FIG. 45 and FIG. 46 show a 18th embodiment as one of such modes.

In this embodiment, the flashlight 3 in the 15th embodiment (refer to FIGS. 37 and 38) is replaced with a tear gas shooting device 151. The tear gas shooting device 151 comprises a gas cylinder 151A charged with a tear gas under pressure and a valve 151D disposed by way of an adaptor 151B to the head of the cylinder 151A so as to be opened/closed by a lever 151C. 151E is a support rod as a center of rotation for the lever 151C and 151F is a gas shooting port.

A user for the police baton draws the lever 151C with a forefinger of hand gripping a crosshandle 2. Then, the lever 151C revolves around the support rod 151E as a fulcrum to open the valve 151D and tear gas is sprayed from the shooting port 151F. When the finger positioned at the lever 151C is released, the lever 151C is pushed back by the resiliency of a return spring 151G to close the valve 151D thereby interrupt the spray of the tear gas.

The user can manipulate the police baton by gripping the crosshandle 2 with one hand, or he can manipulate it while gripping the haft A of the baton main body 1. He can shoot a tear gas at any optional timing while freely manipulating the police baton. The pointing direction of the shooting port 151F is independent of the rotation of the police baton main body 1 is a case of gripping the crosshandle 2 and it aligns with the direction of the hand that grips the crosshandle 2. On the other hand, in a case of gripping the gripping haft A, the shooting port 151F aligns with the pointing direction of the baton main body 1 since it is constrained by the magnetic force of the magnets 110 incorporated in the crosshandle 2.

In this way, in both of the manipulation methods, he can always point the shooting port 151F to the opponent and there is a merit capable of easily repressing the opponent by the combined use of the tear gas and the thrusting by the police baton.

EXAMPLE 19

Figures 47, 48:
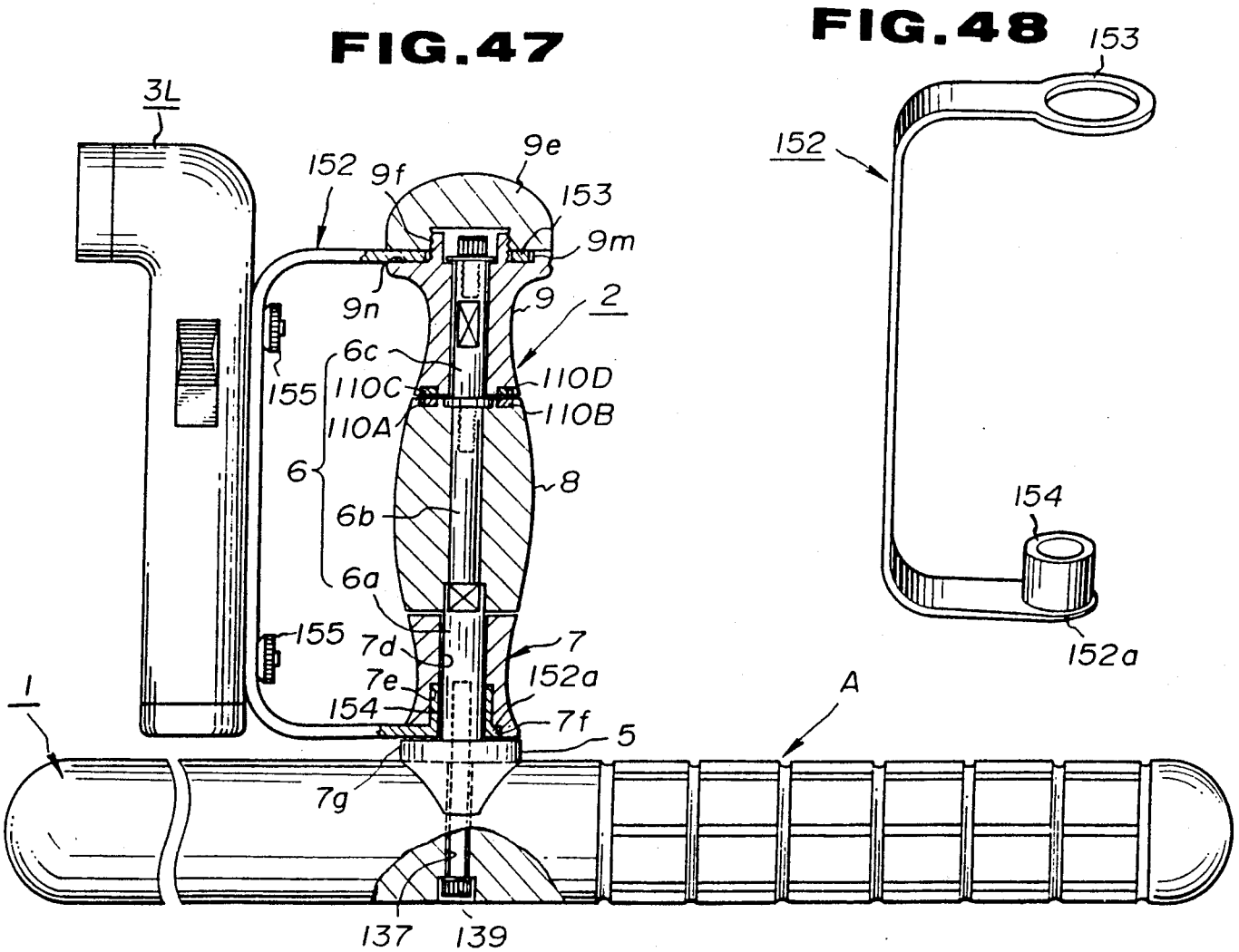
FIG. 47 is a side elevational view partially in vertical cross section of a 19th embodiment according to the present invention.
FIG. 48 is a perspective view of a hand guard shown in FIG. 48.

FIG. 47 and FIG. 48 show a 19th embodiment.

In this embodiment, an L-shaped flashlight 3L is mounted by way of a hand guard 152 to a crosshandle 2.

The hand guard 152 is made, for example, of metal or plastic material formed substantially in a C-shaped configuration as shown in FIG. 48, and has an upper end in the form of an annular upper mounting portion 153 for securing with a relatively rotational upper member 9. On the other hand, it has a lower end 152*a* having a cylindrical lower mounting portion 154 for securing with a relatively rotational lower member 7.

On the other hand, in the crosshandle 2, there are formed a hand guard mounting hole 7*e* with an enlarged inner diameter so as to engage the outer cylindrical diameter of the lower mounting portion 154 of the hand guard 152, a recessed groove 7*f* and a side opening 7*g* for the recessed groove 7*f* for fitting the lower end 152*a* of the hand guard 152 in the lower portion of the through hole 7*d* of the relatively rotational lower member 7. Further, an annular recessed groove 9*h* and an opening 9*i* therefore like that those shown in FIG. 43 are disposed to the upper surface of a relatively rotational upper member 9.

The lower mounting portion 151 of the hand guard 152 is fit in the hand guard mounting hole 7*e* of the relatively rotational lower member 7 of the crosshandle 2 and the lower end 152*a* is fit to the recessed groove 7*f* and the side opening 7*g*. The upper mounting portion 153 of the hand guard 152 is fit and mounted to the annular recessed groove 9*h* and the opening 9*i* therefore of the relatively rotational upper member 9. The L-shaped flashlight 3L is secured by means of mounting screws 155 to the hand guard 152 in parallel with the crosshandle 2.

In a case of manipulating the police baton by gripping the crosshandle 2, the hand guard 152 secured to the relatively rotational lower member 7 and the relatively rotational upper member 9 of the crosshandle 2 are relatively rotatable to the baton main body 1 being independent of the rotation of the baton main body 1 and always points the substantially identical direction with that of the knuckle of the gripping hand. Accordingly, the L-shaped flashlight 3L secured to the hand guard 152 can also be pointed to an opponent like that in each of 13th through 18th embodiments described above.

On the other hand, in a case of manipulation by gripping the gripping haft A of the baton main body 1, the pointing direction of the hand guard 152 and thus the shooting port of the flashlight 3L is controlled to the top end direction of the baton main body 1.

This embodiment can provide a merit capable of protecting the gripping hand of the police baton user. That is, the hand can be protected by the hand guard 152 upon gripping the crosshandle 2 and protected by the crosshandle 2 upon gripping the gripping haft A.

EXAMPLE 20

Figure 49:
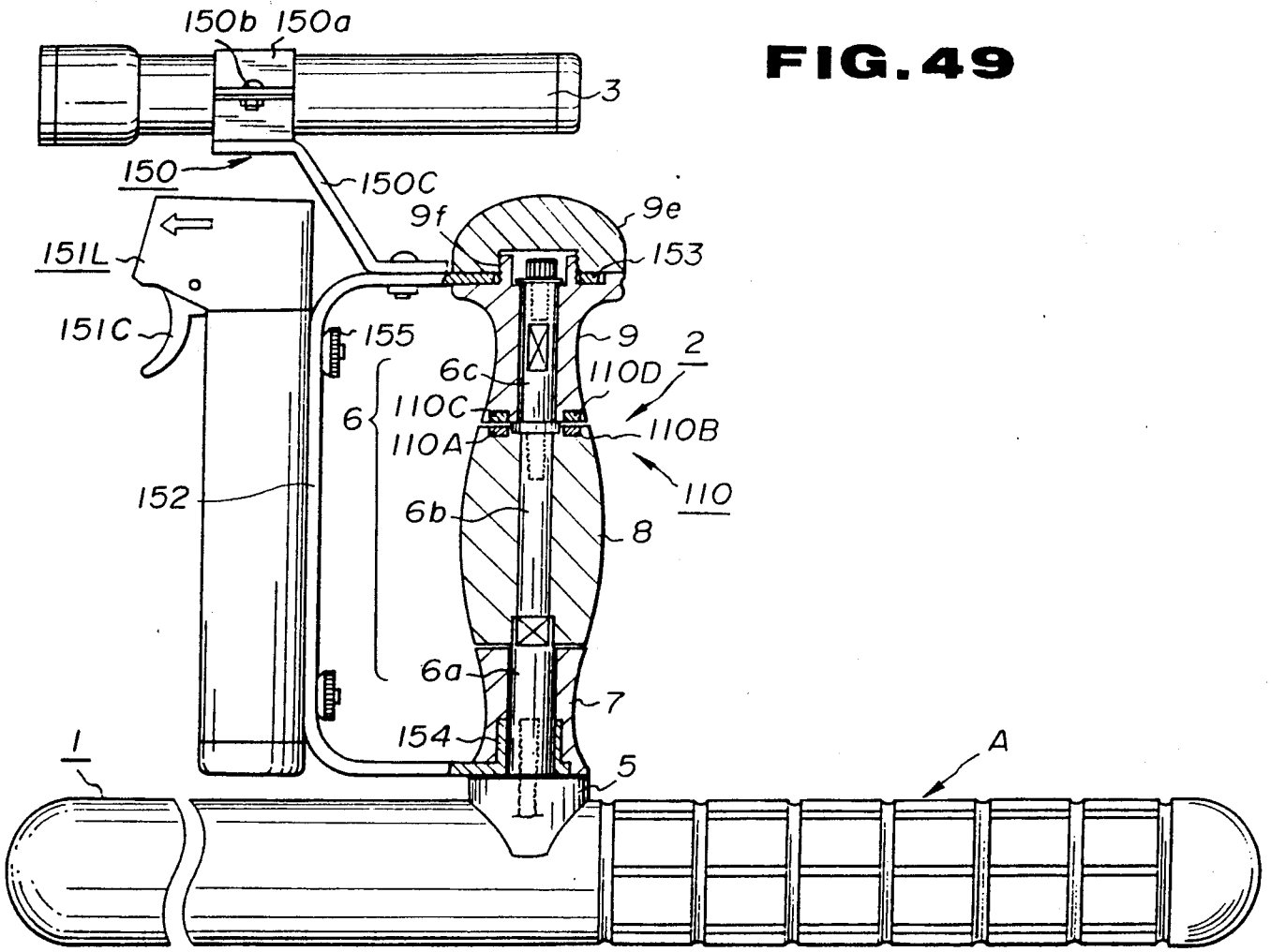
FIG. 49 is a side elevational view partially in vertical cross section of a 20th embodiment according to the present invention.

FIG. 49 shows a 20th embodiment.

In this embodiment, the 19th embodiment having the L-shaped tear gas shooting device 151L mounted by way of the hand guard 152 further has a flashlight 3 mounted by way of a mounting member 150 (with the ring-like base 150*d* being removed.

In a case of manipulation by gripping the crosshandle 2, a hand guard 152 secured to a relatively rotational lower member 7 and a relatively rotational upper member 9 of a crosshandle 2 and the mounting member 150 mounted to the hand guard 152 are rotatable relative to a baton main body 1 independent of the rotation of the baton main body 1 and they alway point substantially the same direction as that of the knuckle of the gripping hand. Accordingly, also the L-shaped tear gas shooting device 151L secured to the hand guard 152 and the flashlight 3 secured to the mounting member 150 can be always pointed to the opponent in the same manner as each of the embodiments described above. On the other hand, in a case of manipulation by gripping the gripping haft A of the baton main body 1, the pointing direction of the shooting ports for the L-shaped tear gas shooting device 151L and the flashlight 3 can be controlled to the direction of the top end of the baton main body 1 by the magnetic attraction force of the magnets 110 incorporated in the crosshandle 2.

This embodiment can provide a merit capable of repressing even a criminal hiding a weapon in the dark more easily by freely manipulating the police baton while illuminating the opponent at night and, further, spraying the tear gas as required.

EXAMPLE 21

Figure 50:
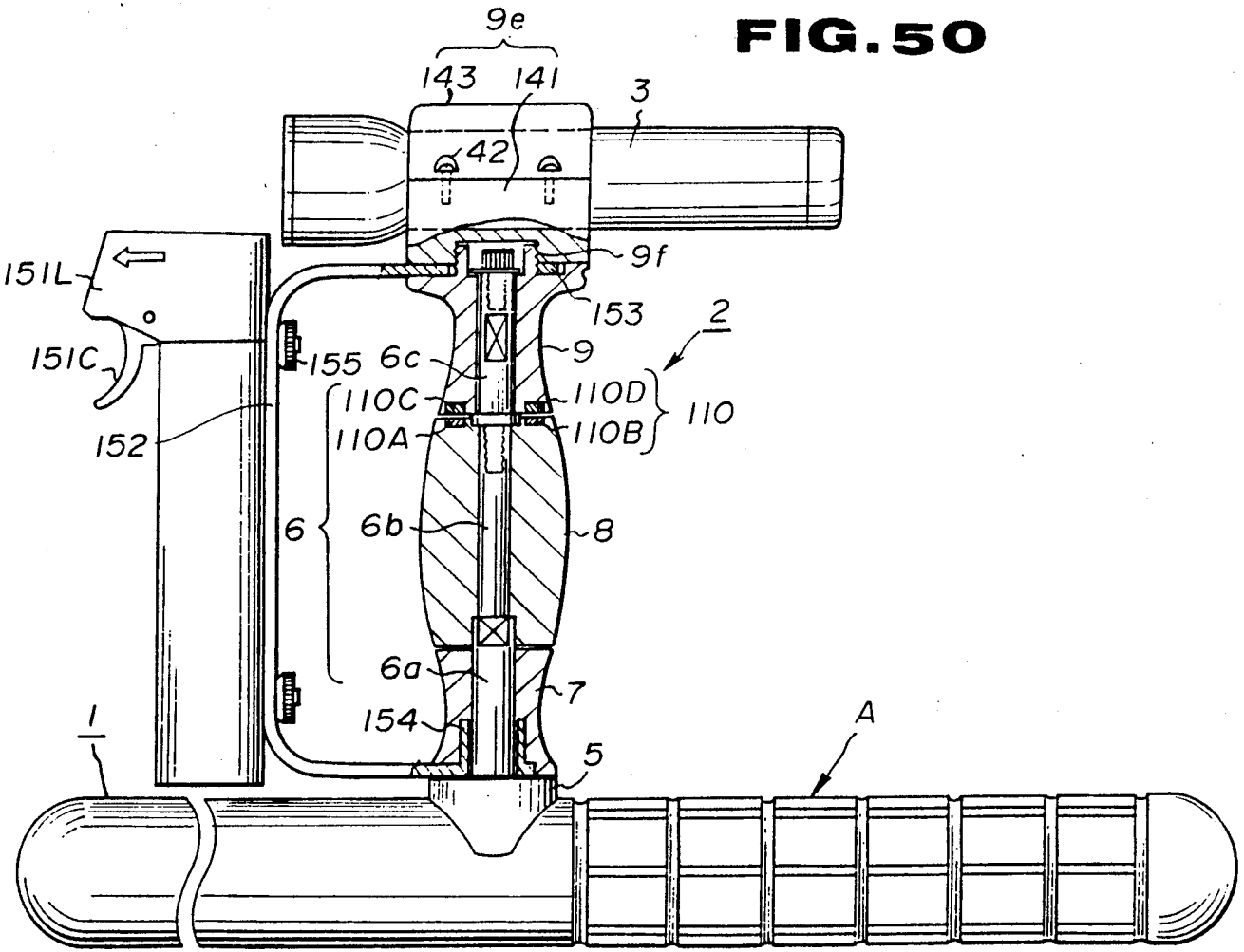
FIG. 50 is a side elevational view partially in vertical cross section of a 21th embodiment according to the present invention.

A 21 th embodiment shown in FIG. 50 uses a flashlight 3 and a tear gas shooting device 151L together like that the 20th embodiment described above. The mounting structure for the flashlight 3 is different in that it is mounted directly to a cap 9*e* of a relatively rotational upper member 9 of a crosshandle 2. That is, the cap 9*e* comprises, like that the 18th embodiment (refer to FIGS. 45 and 46), a square cylindrical cap main body 141 and a saddle-shaped mounting member 143 detachably screw-coupled over the cap main body 141 by means of four setting screws 142.

In this case, there are provided merits that the support for the flashlight 3 is more stable and the height can be reduced to make the structure compact.

EXAMPLE 22

Figure 51:
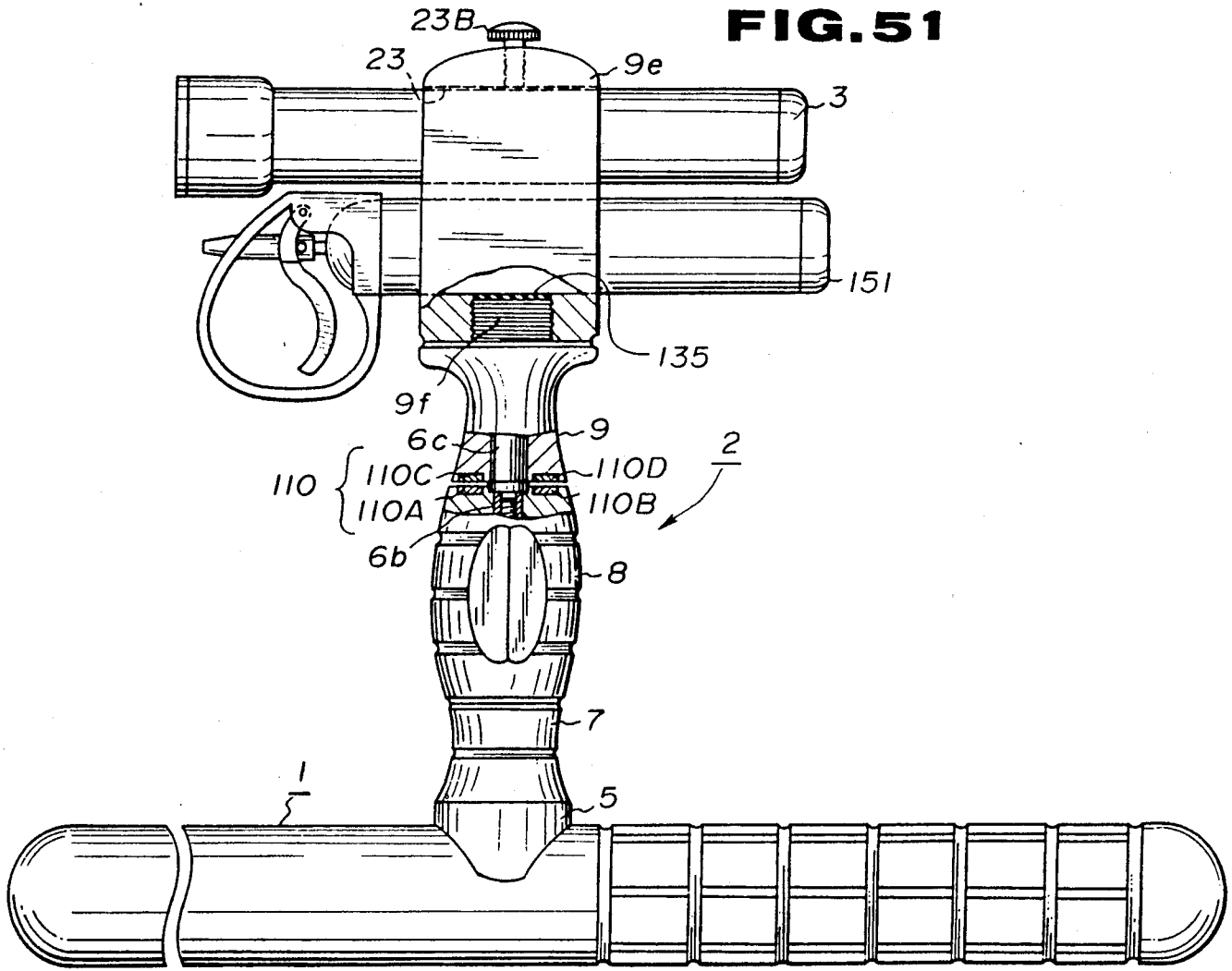
FIG. 51 is a side elevational view partially in vertical cross section of a 22th embodiment according to the present invention.

A 22th embodiment shown in FIG. 51 uses a flashlight 3 and a tear gas shooting device 151 together. In this embodiment, both of them are mounted directly in parallel one above the other to a cap 9*e* of a relatively rotational upper member 9.

The cylindrical cap 9*e* has such a structure of combining that in the 13th embodiment (refer to FIG. 27) and that in the 14th embodiment (refer to FIG. 35) together vertically. That is, the tear gas shooting device 151 is inserted through a through hole 123 in the lower stage of the cap 9*e* and the cap 9*e* is screw-coupled and clamped to the male thread 9*f* of the relatively rotational upper member 9, by which the device 151 is maintained by an urged cushioning rubber member 135. On the other hand, the flashlight 3 is held by being inserted through a through hole 23 in the upper stage of the cap 9*e* and by clamping a set screw 23B. This embodiment is also effective especially for easily repressing an atrocious criminal at night.

Instead of holding the flashlight 3 and the tear gas shooting device 151 in parallel one above the other, they may be maintained in parallel side by side.

In each of the embodiments described previously, the relatively rotational upper member 9 is attached to the top end 6*b* of the shaft 6, for example, by screw-coupling of the bolt 18, but is is not restricted only thereto and retainer ring, welding bonding or like other known attaching means may also be applied.

Furthermore, structures for the grip and the shaft 6 of the crosshandle 2 may not necessarily be restricted only to those of the embodiments but various other modifications are possible. For instance, fixing of the crosshandle 2 to the baton main body 1 is illustrated by a case of screw-coupling with the bolt and a case of inserting the cylindrical portion of the base, but other fixing means such as retaining ring, welding, bonding or the like may also be used.

Alternatively, quite different therefrom, the baton main body 1, the static member 8 of the upper rotational type crosshandle 2 and the shaft protruded from the upper surface of the static member 8 may be formed integrally from a synthetic resin material, and the relatively rotational upper member 9 may be fit around the protruded shaft and rotatably attached by a retaining ring.

Further, although the crosshandle 2 in each of the above-mentioned embodiments has been explained as comprising the relatively rotational upper member 9 and the relatively rotational lower member 7 below and above the static member 8, it may be an upper rotational type comprising the static member 8 and the relatively rotational upper member 9 but not having the relatively rotational lower member 7. In this type, the static member 8 constituting the crosshandle 2 is formed into such an outer shape that the lower end thereof is extended by a portion corresponding to the relatively rotational lower member 7 in each of the embodiments described above and it is fixed to the shaft 6 not rotatably.

The present invention provides a police baton with crosshandle comprising a baton main body having a gripping haft disposed at one end thereof and a crosshandle disposed near the gripping haft, in which the crosshandle comprises at least a static member secured integrally to the baton main body and a relatively rotational upper member disposed rotatably around its axis to the free end of the static member, wherein at least one of shooting devices for light, acoustic wave, electromagnetic wave, gas, liquid and solid is mounted to the crosshandle relatively rotatably to the baton main body around the crosshandle as a center of rotation, and magnets are disposed to the end face at the free end of the static member and to the opposing end face of the relatively rotational upper member of the crosshandle, respectively, for controlling the pointing direction of the shooting device and, accordingly, the police baton can provide the following advantageous effects.

In a case of manipulation conducted by gripping the gripping haft, the shooting direction of the shooting device is automatically aligned with the axial direction of the baton main body under the attitude control by the effect of the magnetic force of the magnets. While on the other hand, in a case of manipulation conducted by gripping the crosshandle, the shooting direction of the shooting device can be controlled to the direction of the hand that grips the relatively rotational upper member independent of the baton main body. Accordingly, it is possible to illuminate an opponent or shoot flashlight, acoustic wave, electromagnetic wave, gas, liquid, solid or the like at any optional timing always along an accurate direction even during manipulation of the police baton by gripping the gripping haft or the crosshandle.

What I claim are:

1. A police baton with crosshandle comprising a baton main body and a crosshandle branched in perpendicular from said baton main body at a position longitudinally displaced from the center to one end of said baton main body, wherein at least one of shooting devices for light, acoustic wave, electromagnetic wave, gas, liquid and solid is mounted to said crosshandle relatively rotatably to said baton main body around said crosshandle as a center of rotation.

2. A police baton with crosshandle as defined in claim 1, wherein the crosshandle comprises at least a static member secured to the baton main body and a relatively rotational upper member rotatably attached to a free end of said static member, in which the shooting device is mounted to the relatively rotational upper member directly or by way of a mounting member.

3. A police baton with crosshandle as defined in claim 1, wherein the crosshandle comprises at least a static member secured to the baton main body and a relatively rotational upper member rotatably attached to a free guard generally in a C-shaped configuration having an upper end mounted to said relatively rotational upper member and made relatively rotatable around the crosshandle as a center of rotation, in which the shooting device is mounted to the crosshandle by way of said hand guard.

4. A police baton with crosshandle comprising a baton main body having a gripping haft at one end thereof and a crosshandle branched in perpendicular from said baton main body at a position longitudinally displaced toward said gripping haft, in which said crosshandle comprises at least a static member secured to the baton main body and a relatively rotational upper member attached rotatably to a free end of said static member, wherein at least one of shooting devices for light, acoustic wave, electromagnetic wave, gas, liquid and solid is mounted to said crosshandle relatively rotatably to said baton main body around said crosshandle as a center of rotation, and magnets are disposed to the end face at the free end of said static member and the opposing end face of the relatively rotational upper member of said crosshandle, respectively, for controlling the pointing direction of said shooting device.

* * * * *